US005767810A

United States Patent [19]

Hagiwara et al.

[11] Patent Number: 5,767,810

[45] Date of Patent: Jun. 16, 1998

[54] MICROSTRIP ANTENNA DEVICE

[75] Inventors: Seiji Hagiwara; Koichi Tsunekawa, both of Yokosuka, Japan

[73] Assignee: NTT Mobile Communications Network Inc., Japan

[21] Appl. No.: 682,572

[22] PCT Filed: Mar. 8, 1996

[86] PCT No.: PCT/JP96/00582

§ 371 Date: Jul. 24, 1996

§ 102(e) Date: Jul. 24, 1996

[87] PCT Pub. No.: WO96/34426

PCT Pub. Date: Oct. 31, 1996

[30] Foreign Application Priority Data

Apr. 24, 1995 [JP] Japan ..... 7-099010
Jun. 5, 1995 [JP] Japan ..... 7-137843

[51] Int. Cl.[6] ..... H01Q 1/38

[52] U.S. Cl. ..... 343/700 MS; 343/702

[58] Field of Search ..... 343/700 MS, 702; H01Q 1/38, 13/08

[56] References Cited

U.S. PATENT DOCUMENTS 4,924,237 5/1990 Honda et al. ..... 343/702
5,148,181 9/1992 Yokoyama et al. ..... 343/700 MS

FOREIGN PATENT DOCUMENTS 63-294107 11/1988 Japan .
3-157005 7/1991 Japan .

*Primary Examiner*—Michael C. Wimer
*Attorney, Agent, or Firm*—Pollock, Vande Sande & Priddy

[57] ABSTRACT

In a microstrip antenna device which has a radiating patch and a ground plate disposed opposite and in parallel to each other, a metal plate is provided on the ground plate in the vicinity of at least one of the opposite marginal edges of the radiating patch in the direction of resonance to form an added capacitance between an open end of the radiating patch in the direction of resonance and the ground plate, thereby permitting reduction of the antenna length.

9 Claims, 23 Drawing Sheets

L=40mm

L=10mm

ANTENNA RESONANCE CHARACTERISTIC

- - - - - : P = O (ch a)

——— : P = 1 (ch b)

MICROSTRIP ANTENNA DEVICE

TECHNICAL FIELD

The present invention relates to a microstrip antenna device in which a radiating patch is disposed adjacent but opposite to a ground plate and an inner and an outer conductor of a coaxial feeder are connected to the radiating patch and the ground plate, respectively.

PRIOR ART

In FIG. 1 there is shown an example of a conventional microstrip antenna device. In the conventional microstrip antenna a radiating patch 11 is disposed on a ground plate 12 in adjacent but opposite relation thereto with a dielectric substrate 13 sandwiched therebetween, a coaxial feeder 14 has its inner conductor connected at one end to the radiating patch 11 substantially centrally thereof through small holes made in the ground plate 12 and the dielectric substrate 13 and has its outer conductor connected to the ground plate 12, the other end of the coaxial feeder 14 being connected to a transmitter or receiver 15. Here, the length L of the radiating patch 11 is about 0.5 λe. λe is a guide wavelength given by $\lambda e=\lambda x\ 1\sqrt{\epsilon_r}$, where λ is the wavelength in a vacuum and $\epsilon_r$ is the dielectric constant of the dielectric substrate 13. This microstrip antenna yields a main lobe in a direction perpendicular to the radiating patch 11, developing a current distribution which is maximum at the center of the radiating patch 11 lengthwise thereof (in the direction of the length L) and minimum at its both ends. That is to say, the conventional microstrip antenna has its length L defined by 0.5 λe and is used in a half-wave resonant state.

The antenna length of the microstrip antenna, that is, the length L of the radiating patch 11, could be decreased by increasing the dielectric constant of the dielectric substrate 13. However, an increase in the dielectric constant increases also the dielectric loss, and hence impairs the antenna efficiency. With a view to reducing the antenna length L, there has been proposed an antenna in which the radiating patch 11 has slits SL extending from its edges as shown in FIG. 2 ('84 National Conference of IECEJ Communication Department, No. 624: A Discussion about Miniaturization of an Inverted F Type Antenna). With the use of this scheme, it is possible to lower the resonance frequency by increasing the number of slits SL and their length without increasing the dielectric constant of the dielectric substrate 13, with the result that the antenna length L is reduced. It has been reported, however, that the slits SL disturb current and hence impair the antenna efficiency when the antenna length L is short, even if the dielectric substrate 13 is formed of a low-loss material.

In Japanese Patent Application Laid-Open Gazette No. 29204/83 (Feb. 21, 1983) there is proposed a microstrip antenna which has a variable capacitance diode connected between one end of the radiating patch in a direction at an angle of 45 degrees to the direction of resonance and the ground plate to make the resonance frequency variable, but this is intended to radiate circularly polarized waves and hence has nothing to do with the miniaturization of the antenna. In Japanese Patent Application No. 124605/90 (May 1, 1990) there is proposed a microstrip antenna which has a variable capacitance element disposed in a space made in the dielectric substrate between the radiating patch and the ground plate for interconnecting them to make variable the frequency band used. The half-wave microstrip antenna with a square radiating patch whose side is 60 mm, exemplified in the above-mentioned application, is said to have a 1.42 GHz resonance frequency. In this half-wave antenna, if the dielectric constant $\epsilon_r$ of the dielectric substrate is set at 2 to 3, the length of the side of the radiating patch reversely obtainable from the 1.4-GHz resonance frequency (the wavelength λ in a vacuum is around 20 cm) is $\lambda e/2=\lambda/(2\sqrt{\epsilon_r})=70\sim60$ mm, which is nearly equal to the length 60 mm; hence, the above-mentioned capacitance does not contribute to the miniaturization of the antenna.

The length L of the radiating patch 11 of the microstrip antenna shown in FIG. 1 could be reduced by operating the antenna as a quarter-wave strip antenna. FIG. 3 illustrates an example of a conventional quarter-wave microstrip antenna. Reference numeral 11 denotes a radiating patch, 12 a ground plate, 13 a dielectric substrate, 14 a coaxial feeder, 15 a transmitter or receiver and 23 a short-circuit plate. By setting the length L of the radiating patch 11 at λe/4 and bending its one marginal portion for connection to the ground plate 12 as depicted in FIG. 3, the function of the quarter-wave microstrip antenna can be performed. In this case, the length L of the radiating patch is substantially $(\lambda 4)\sqrt{\epsilon_r}$, where $\epsilon_r$ is the dielectric constant of the dielectric substrate 13 and λ the wavelength in a vacuum. Hence, the length L of the radiating patch could be reduced by increasing the dielectric constant of the dielectric substrate, but the dielectric loss also increases accordingly, impairing the antenna efficiency. Further, the resonance frequency is determined uniquely by the length L.

In the conventional half-wave and quarter-wave microstrip antennas, the antenna length L is reduced by using the dielectric substrate 13 of a high dielectric constant or cutting the Slits SL in the radiating patch 11 as described above. But the former increases the dielectric loss and the latter causes a current disturbance over the radiating patch; hence, either method has the defect of impairing the antenna efficiency. Moreover, since the resonance frequency depends on the length L of the radiating patch 11, either antenna cannot be shared with multiple frequencies. Additionally, the bandwidth is also narrow.

It is an object of the present invention to provide a microstrip antenna device which is small in antenna length, high in efficiency and usable over a wide band or multi-frequency range.

SUMMARY OF THE INVENTION

The microstrip antenna device according to a first aspect of the present invention comprises: a ground plate; a radiating patch disposed in parallel with the ground plate in opposed but spaced relation thereto, a coaxial feeder having its inner and outer conductors connected to the radiating patch and the ground plate, respectively, and an added capacitance means disposed between at least one of the opposite sides of the radiating patch in the direction of resonance and the grounding conductor.

With such a configuration, the antenna length can be reduced without impairing the antenna efficiency in either of half-wave and quarter-wave antennas.

The added capacitance means is provided by placing a metal plate on the ground plate in adjacent but opposed relation to an open side of the radiating patch, connecting a capacitor between the open side of the radiating patch and the ground plate, or bending the marginal portion of the open side of the radiating patch through 90 degrees toward the ground plate to form a small radiating patch. The antenna length could be further reduced by connecting a constant capacitance element between the open side of the radiating patch and the metal plate, or between the small radiating patch and the ground plate.

According to a second aspect of the present invention, two resonance frequencies can be selectively used by replacing the above-mentioned capacitor with a series connection of a switch and a constant capacitance element, and the resonance frequency can be continuously varied by replacing the capacitor with a variable capacitance or a series connection of a constant capacitance element and a variable capacitance element. Similarly, a plurality of resonance frequency can be selectively used or the resonance frequency can be continuously varied by replacing the constant capacitance element connected between the open side of the radiating patch and the metal plate with a series connection of a constant capacitance element and a switch, or a variable capacitance element, or a series connection of a constant capacitance element and a variable capacitance element.

BEST MODE FOR CARRYING OUT THE INVENTION

Figure 1:
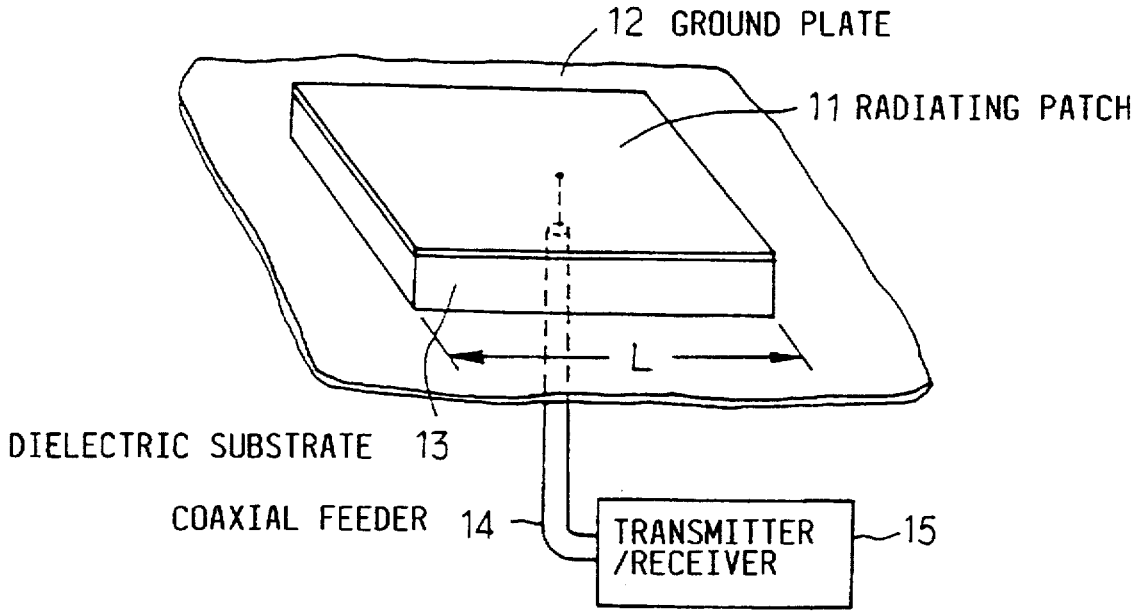
FIG. 1 PRIOR ART
FIG. 1 is a perspective view for explaining the prior art.
Figure 4:
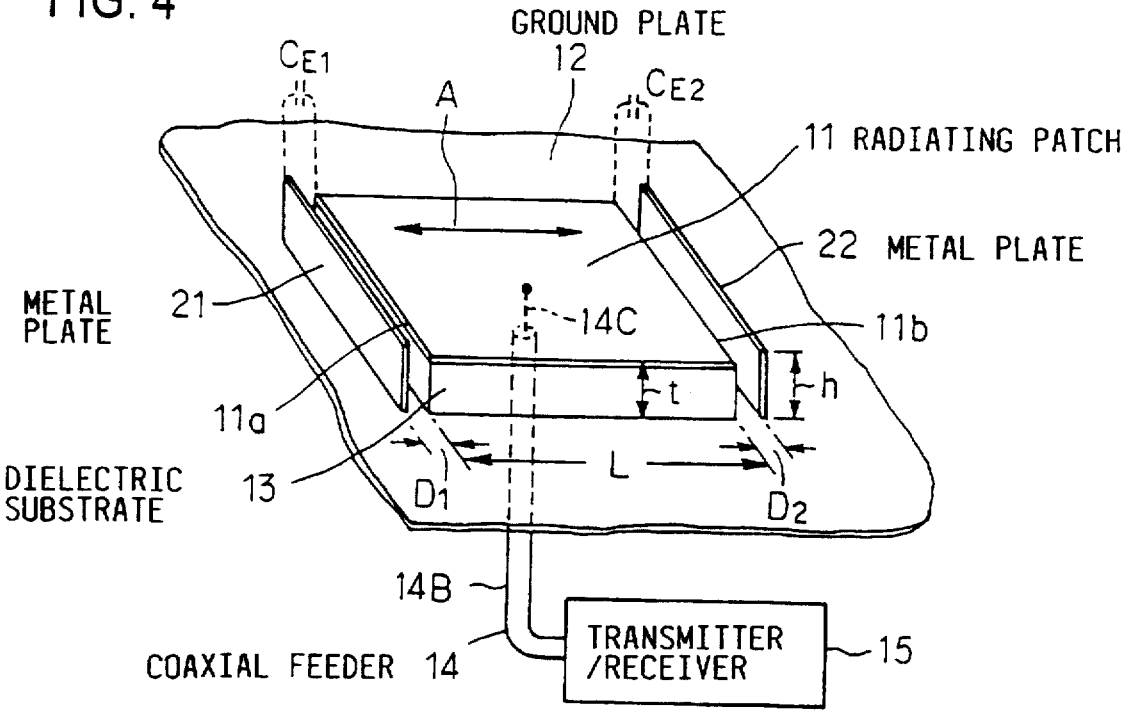
FIG. 4 is a perspective view illustrating an embodiment of a half-wave microstrip antenna device of the present invention which has added capacitances formed by placing metal plates in adjacent but opposed relation to open sides of the radiating patch.

In FIG. 4 there is illustrated a first embodiment of the microstrip antenna device according to the present invention, which is a half-wave microstrip antenna device of the same construction as that of the FIG. 1 prior art example wherein the radiating patch 11 is mounted on the dielectric substrate 13 formed on the ground plate 12. The parts corresponding to those in FIG. 1 are identified by the same reference numerals. An outer conductor 14B of the coaxial feeder 14 from the transmitter or receiver 15 is connected to the grounding conductor 12 and an inner conductor 14C is connected to the radiating patch 11 through a throughhole (not shown) made in the dielectric substrate 13. In this embodiment, metal plates 21 and 22 are supported on the ground plate 12 adjacent to and in parallel with opposite marginal edges 11*a* and 11*b* of the square radiating patch 11 which cross at right angles the direction of resonance indicated by the arrow A, while at the same time the metal plates are electrically connected to the ground plate. The metal plates 21 and 22 are perpendicular to both the ground plate 12 and the radiating patch 12, and their height h from the ground plate 12 is set at less than three times as large as the spacing t between the radiating patch 11 and the ground plate 12. The metal plates 21 and 22 are adjacent to but slightly spaced away from the opposite marginal edges 11*a* and 11*b* of the radiating patch 11 along the entire length thereof with gaps $D_1$ and $D_2$ defined between them, respectively, by which additional capacitors $C_{E1}$ and $C_{E2}$ are equivalently formed as indicated by the broken lines. In other words, the opposite marginal edges 11*a* and 11*b* of the radiating patch 11 are connected to the ground plate 12 via the capacitors $C_{E1}$ and $C_{E2}$, respectively. It is also possible to extend the length of the dielectric substrate 13 in the direction of resonance A so that its opposite end faces come into contact with the metal plates 21 and 22. If some means is provided for supporting the radiating patch 11, the dielectric substrate 13 may also be air.

Figure 2:
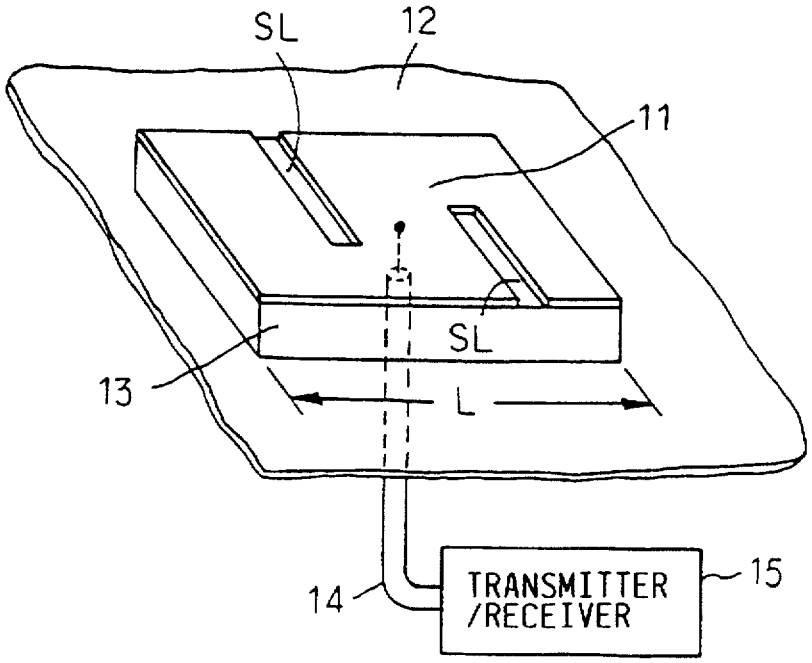
FIG. 2 PRIOR ART
FIG. 2 is a perspective view showing a conventional antenna miniaturized by cutting slits in a radiating patch.
Figure 5:
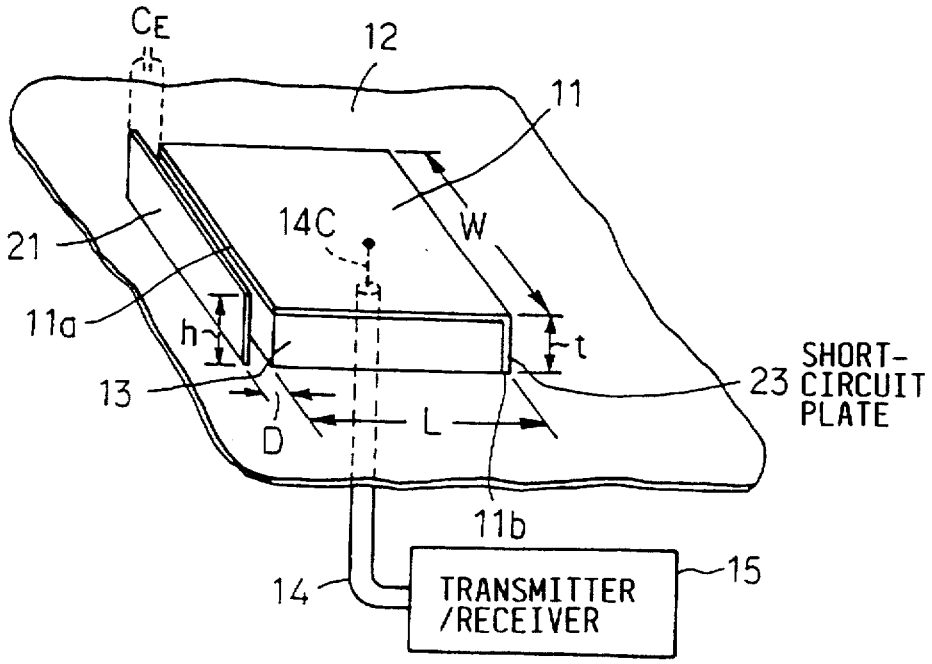
FIG. 5 is a perspective view illustrating an embodiment of a quarter-wave microstrip antenna device of the present invention which has an added capacitance formed by a metal plate.

FIG. 5 illustrates another embodiment of the present invention applied to a quarter-wave microstrip antenna similar to that shown in FIG. 2. The parts corresponding to those in FIG. 4 are identified by the same reference numerals. Since this antenna is a quarter-wave microstrip antenna, one marginal portion of the square radiating patch 11 in the direction of resonance is bent through 90 degrees to form a short-circuit plate 23, hence the radiating patch 11 is mechanically coupled to and electrically short-circuited to the ground plate 12 via the marginal edge 11*b*, with the result that the length L of the radiating patch 11 in the direction of resonance is reduced to about one-half that in FIG. 4 and the inner conductor 14C of the coaxial feeder 14 is connected to the radiating patch 11 in the vicinity of the short-circuit plate 23. The metal plate 21 is supported on the ground plate 12 so that it is separated by a gap D from the marginal edge 11*a* of the radiating patch 11 along the entire length thereof on the side opposite from the short-circuit plate 23. By this, a capacitor $C_E$ is equivalently formed between the marginal edge 11*a* of the radiating patch 11 and the ground plate 12 as indicated by the broken line.

Figure 6A:
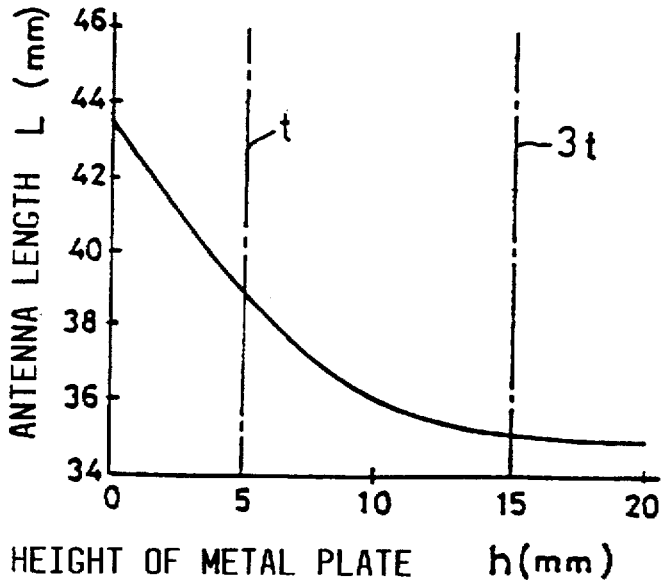
FIG. 6A is a graph showing the relationship between the height h of the metal plate and the antenna length L in the microstrip antenna device of FIG. 5.
Figure 6B:
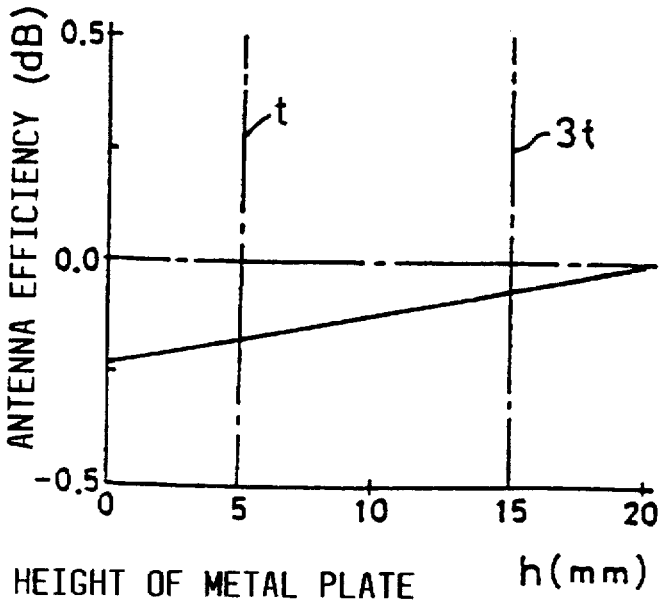
FIG. 6B is a graph showing the relationship between the height h of the metal plate and the antenna efficiency.

To prove the effect of the microstrip antenna device according to the present invention, experiments were conducted on the device of the FIG. 5 embodiment. In the experiments, the frequency used is 1.49 GHZ, the width W of the radiating patch 11 is 30 mm, the height t of the radiating patch 11 is 5 mm, the distance D between the radiating patch 11 and the metal plate 21 is 1 mm, and the dielectric substrate between the radiating patch 11 and the ground plate 12 is air. In FIG. 6 there is shown the relationship between the height h of the metal plate 21 and the antenna length (the length of the radiating plate 11 in the direction of resonance) L for holding the resonance frequency at 1.49 Ghz. In the absence of the metal plate 21 (h=0 mm), the antenna length L necessary for keeping the resonance frequency at 1.49 Ghz is 43.5 mm, which is close to a quarter wavelength $\lambda/4$ of 50 mm. When the metal plate 21 is provided, the resonance antenna length L abruptly decreases with an increase in the height h of the metal plate 21, and when the height h is 20 mm (=4 t), the antenna length L for resonance at 1.49 Ghz is 35 mm. Thus, it can be seen that the antenna length can be reduced as much as 8.5 mm by the provision of the metal plate 21. However, when the height h of the metal plate 21 is 15 mm or 3 t, the effect of reducing the antenna length L is closely approaching saturation, and an increase in the height h will no longer produce any particular antenna reduction effect. FIG. 6B shows the relationship of the antenna efficiency to the height h of the metal plate 21. It appears from FIG. 6 that the antenna efficiency improves with an increase in the height h of the metal plate 21.

From the above it can be seen that the metal plate 21 placed close to the radiating patch 11 makes it possible to reduce the antenna length L with an increase in its height, permitting miniaturization of the antenna structure and improving the antenna efficiency. Further, it is also apparent from FIGS. 6A and 6B that the height h of the metal plate 21 may preferably be set up to about three times the height t of the radiating patch 11 in order for the metal plate 21 to produce the effect of reducing the antenna length L (FIG. 6A). Accordingly, it is preferable in the present invention that the height h be chosen in the range of $0<h\leqq 3$ t.

Thus, the effectiveness of the present invention applied to the quarter-wave antenna of FIG. 5 can be confirmed from FIGS. 6A and 6B. It is considered that the basic antenna structure depicted in FIG. 4 will exhibit the same characteristic as that of the antenna shown in FIG. 5. On this account, the heights h of the metal plates 21 and 22 are also limited to $0<h\leqq 3$ t in FIG. 4.

Figure 7A:
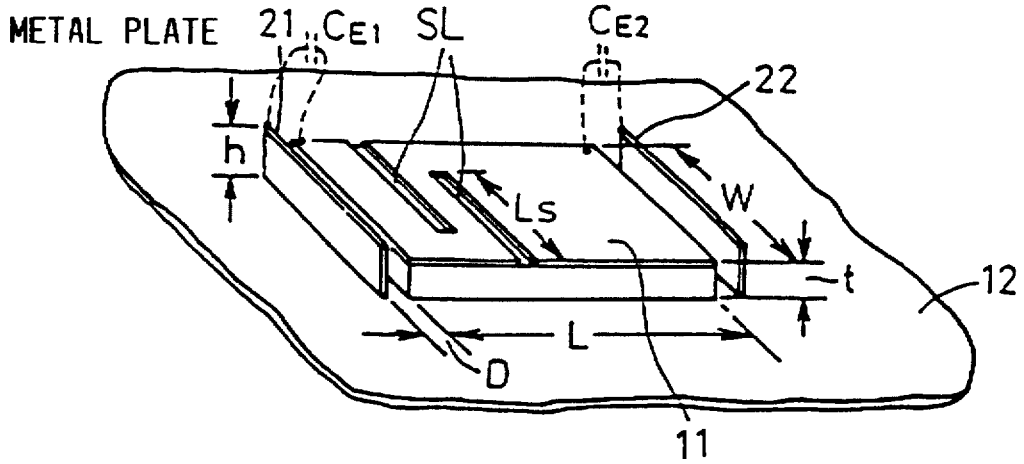
FIG. 7A is a perspective view illustrating another embodiment of the half-wave microstrip antenna device which has slits cut in the radiating patch.
Figure 7B:
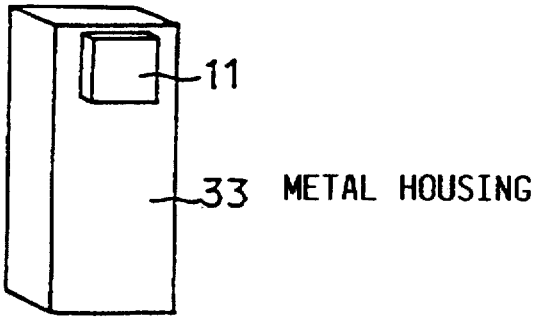
FIG. 7B is a perspective view of a housing used in experiments.
Figure 8:
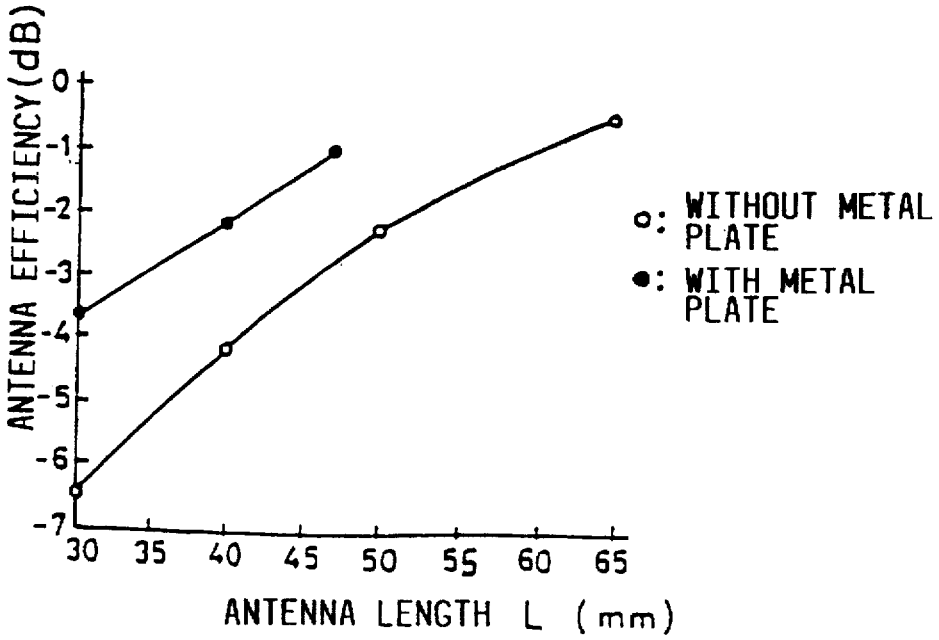
FIG. 8 is a graph showing the relationship between antenna lengths and measured antenna efficiency.

In FIG. 7A there is illustrated, in perspective, another embodiment of the present invention as being applied to the half-wave microstrip antenna device of the FIG. 2 prior art example. As is the case with the FIG. 4 embodiment, the metal plates 21 and 22 are provided opposite the two marginal edges of the radiating patch 11 in FIG. 2 along their entire length to equivalently form the capacitors $C_{E1}$ and $C_{E2}$ between the opposite ends of the radiating patch 11 and the ground plate 12. The following experiments were conducted with a view to demonstrating the antenna miniaturization effect by applying the conventional slits to the present invention. As shown in FIG. 7B, the microstrip antenna of FIG. 7A was mounted on, for example, the upper portion of one main face of a metallic enclosure (130 by 40 by 18 mm) 33 of a portable telephone, using the main face of the enclosure 33 as the ground plate 12. Two slits SL similar to those in the FIG. 2 prior art example were cut in the radiating patch 11 of the antenna, and the antenna efficiency was examined with the lengths $L_s$ of the slits adjusted so that the antenna would resonate at 1.49 GHz with the same antenna length L. The height t of the radiating patch 11 was 3.2 mm, the width W of the radiating patch 11 was 30 mm, the heights h of the metal plates 21 and 22 were 5 mm=1.6 t and the distance D between each metal plate 21 and 22 and the radiating patch 11 was 1 mm. In FIG. 8 there is shown the relationship between the antenna length L and the antenna efficiency of the microstrip antenna in this instance, that is, how the antenna efficiency varied depending on whether the metal plates 21 and 22 were provided (FIG. 7A) or not (FIG. 2) when the antenna length L was 40 mm. It can be seen that the antenna efficiency was raised 2 dB by the provision of the metal plates 21 and 22. To attain the same antenna efficiency without the metal plates 21 and 22, the antenna length needs to be made about 10 mm longer.

As will be appreciated from the above, in the miniaturized antenna with the slits SL cut in the radiating patch 11, it is effective that the metal plates 21 and 22 of the height h less than three times the height t of the radiating patch 11 are placed near the marginal edges (radiating edges) of the radiating patch 11 in the direction of its resonance.

Figure 9:
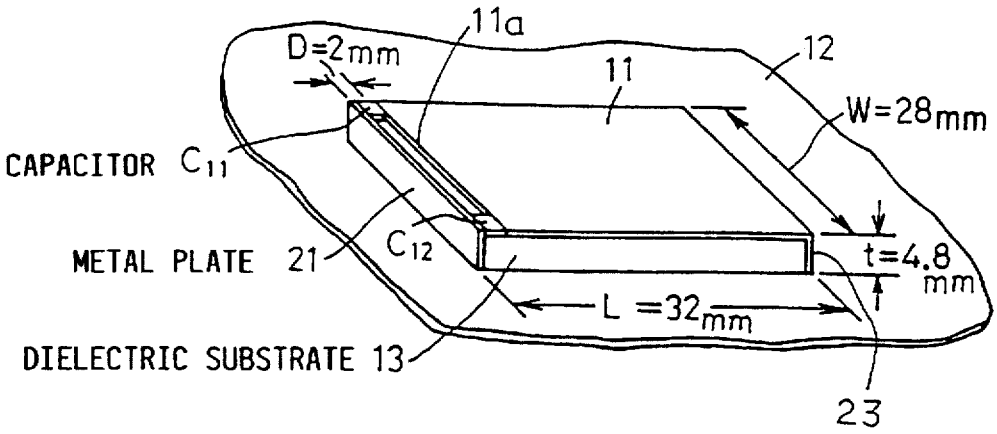
FIG. 9 is a perspective view illustrating another embodiment of the present invention which has a capacitor connected between a metal plate and the radiating patch.

The graph of FIG. 6A shows that, in the embodiment of FIG. 5, an increase in the height h of the metal plate 21 causes a decrease in the length L of the radiating patch 22 at which the antenna resonates at 1.49 GHz as described previously, but the antenna shortening effect is saturated even if the height t is larger than 3 t. This is considered to be due to the fact that since the distance D between the metal plate 21 and the radiating patch 11 is fixed in the FIG. 5 embodiment, an increase in the capacity of the capacitor $C_E$ is saturated even if the height h of the metal plate 21 is made larger than 3 t. Then, the antenna device of FIG. 5 could be further miniaturized by increasing the overall capacity by connecting capacitors $C_{11}$ and $C_{12}$ between the metal plate 21 and the marginal edge 11*a* of the radiating patch 11 as shown in FIG. 9. Experiments were conducted to confirm this. The height t of the radiating patch 11 and the height h of the metal plate 21 were both 4.8 mm and the antenna efficiency was measured with the antenna mounted on the metal housing 33 depicted in FIG. 7B. The frequency for measurement is f=820 MHz. The experiments revealed that the antenna efficiency of the FIG. 9 embodiment cut down only 1 dB even by the reduction of the antenna length from 60.5 to 32 mm. Hence, the use of the metal plate and the capacitor is effective in miniaturizing antennas.

Figure 10:
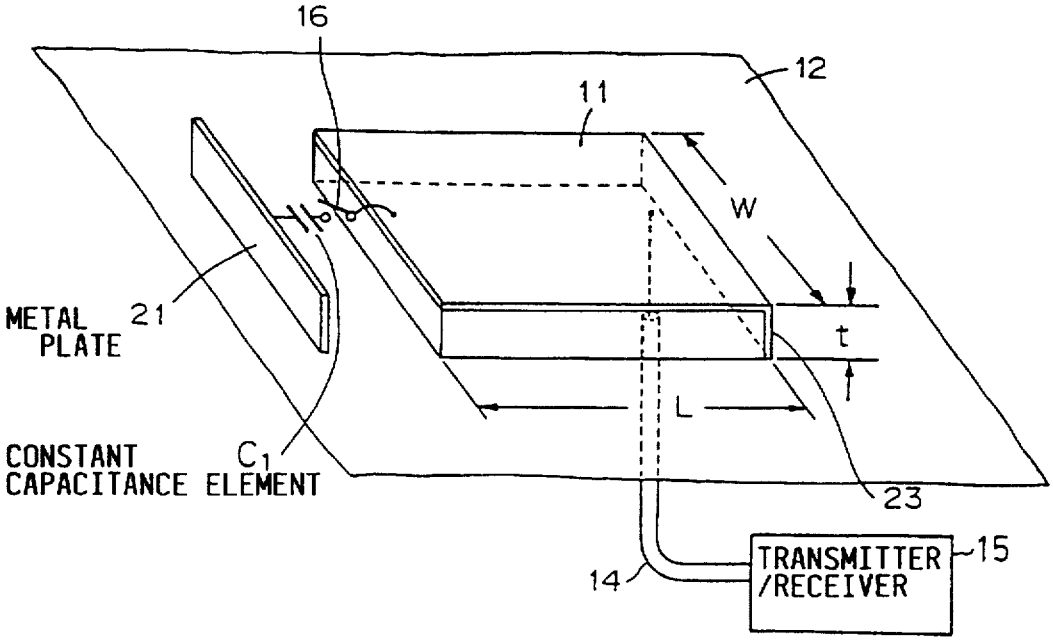
FIG. 10 is a perspective view illustrating a modified form of the FIG. 5 embodiment which employs resonance frequency switching means.

In FIG. 10 there is illustrated another embodiment in which a switch is inserted in series with the capacitor connected between the metal plate 21 and the radiating patch 11 to turn ON and OFF the connection of the capacitor, thereby switching the resonance frequency of the antenna. The FIG. 10 example shows an application of the selective capacitor connecting configuration to the quarter-wave microstrip antenna shown in FIGS. 5 and 9. In FIG. 10, $C_1$ denotes a constant capacitance element which expresses in electrical notation the capacitors $C_{11}$ and $C_{12}$ in FIG. 9. When the switch 16 is in the OFF state, the capacitor $C_1$ is disconnected from the radiating patch 11 and the antenna device resonates at the higher frequency, whereas when the switch 16 is in the ON state, the capacitor $C_1$ is connected to the radiating patch 11 and the antenna device resonates at the lower frequency. While the FIG. 10 embodiment is shown to employ the configuration for switching between two resonance frequencies, it is possible to switch the antenna among three or more resonance frequencies by providing three or more series connection of the capacitor $C_1$ and the switch 16 in parallel relation. The switch 16 may be either electronic or mechanical.

Figure 11A:
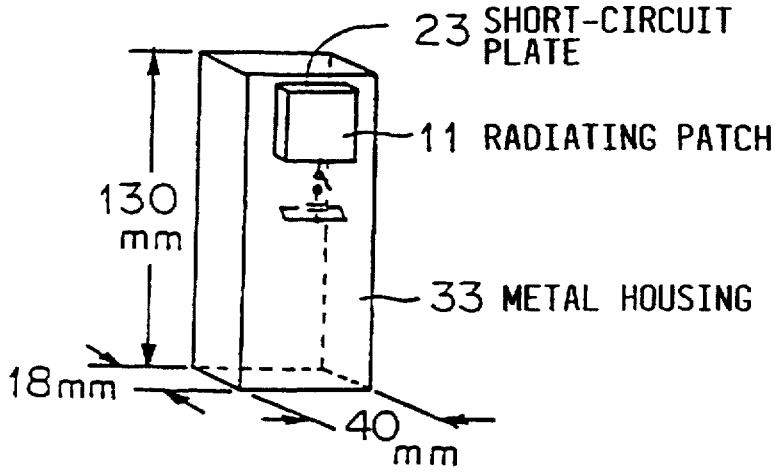
FIG. 11A is a perspective view for explaining the mounting of the microstrip antenna device of FIG. 10 on a metallic box.
Figure 11B:
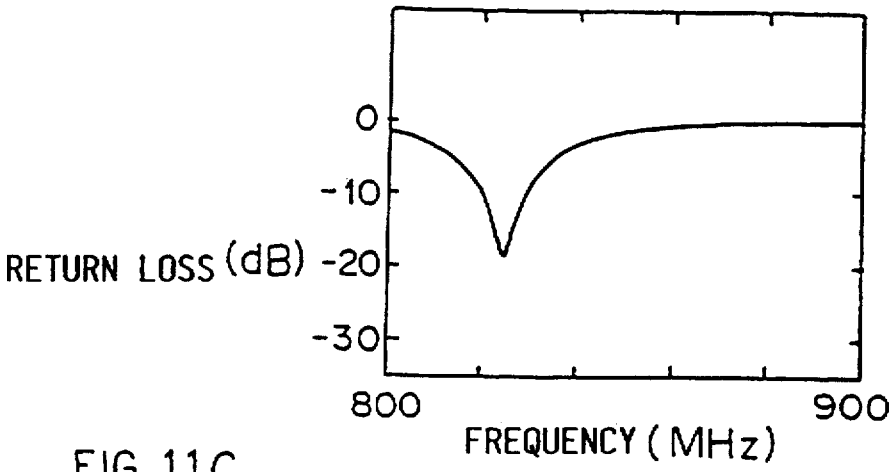
FIG. 11B is a graph showing the return loss for explaining the resonance characteristic of the microstrip antenna device mounted on the metal housing.
Figure 11C:
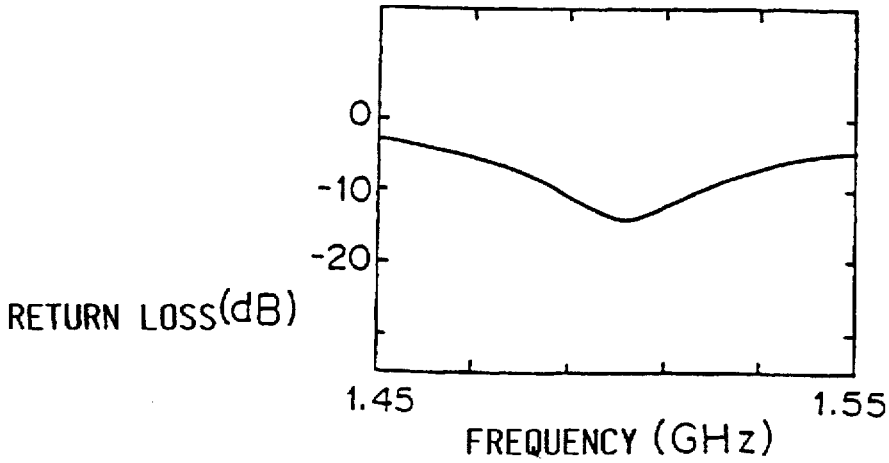
FIG. 11C is a graph showing the return loss for explaining the resonance characteristic of the microstrip antenna mounted on the metal housing.

FIGS. 11B and 11C show return loss-frequency characteristics of the antenna of FIG. 10 measured when it was mounted on the metal housing 33 as depicted in FIG. 11A. The dimensions of the antenna were: L=30 mm, W=25 mm and t=4.8 mm (see FIG. 10). The dielectric constant of the dielectric substrate 13 was $\epsilon_r$=2.6 and the capacity of the capacitor $C_1$ was 4 pF. With the switch 16 held ON, the antenna resonates at about 825 MHz as shown in FIG. 11B, and when the switch 16 is OFF, the antenna resonates at about 1.5 GHz as shown in FIG. 11C. In this way, the antenna can be made to resonate at a selected one of two resonance frequencies by switching the switch 16. This embodiment produces the same effects as those of the other embodiment except for the above.

Figure 12:
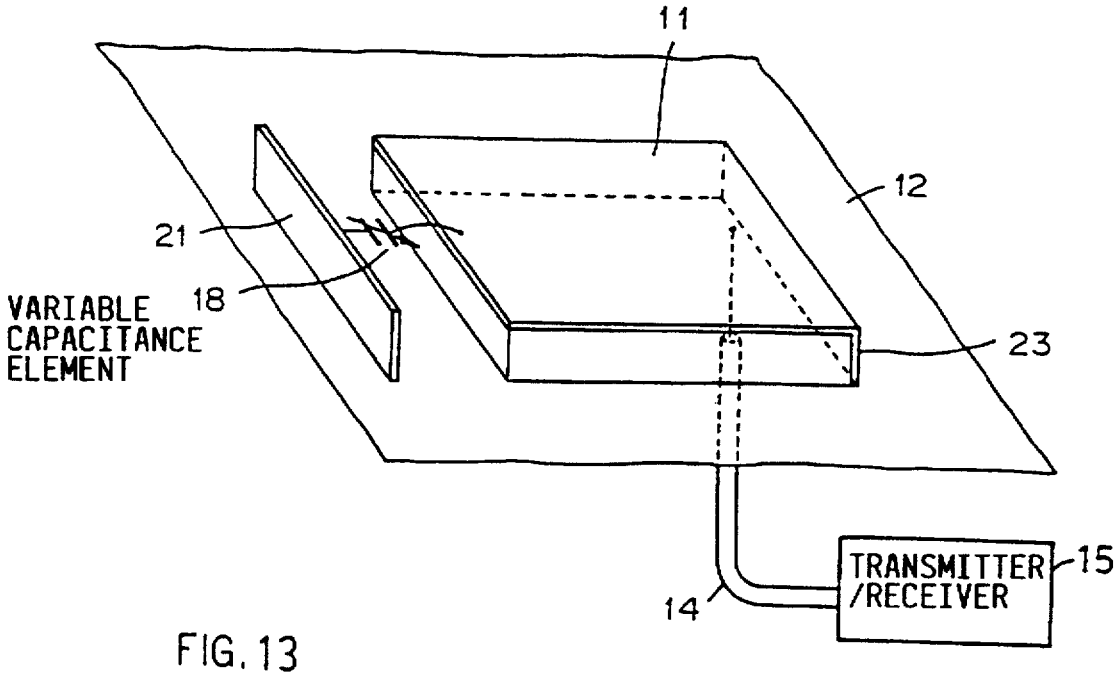
FIG. 12 is a perspective view illustrating another modified form of the FIG. 5 embodiment which has a variable capacitance element as resonance frequency switching means.
Figure 13:
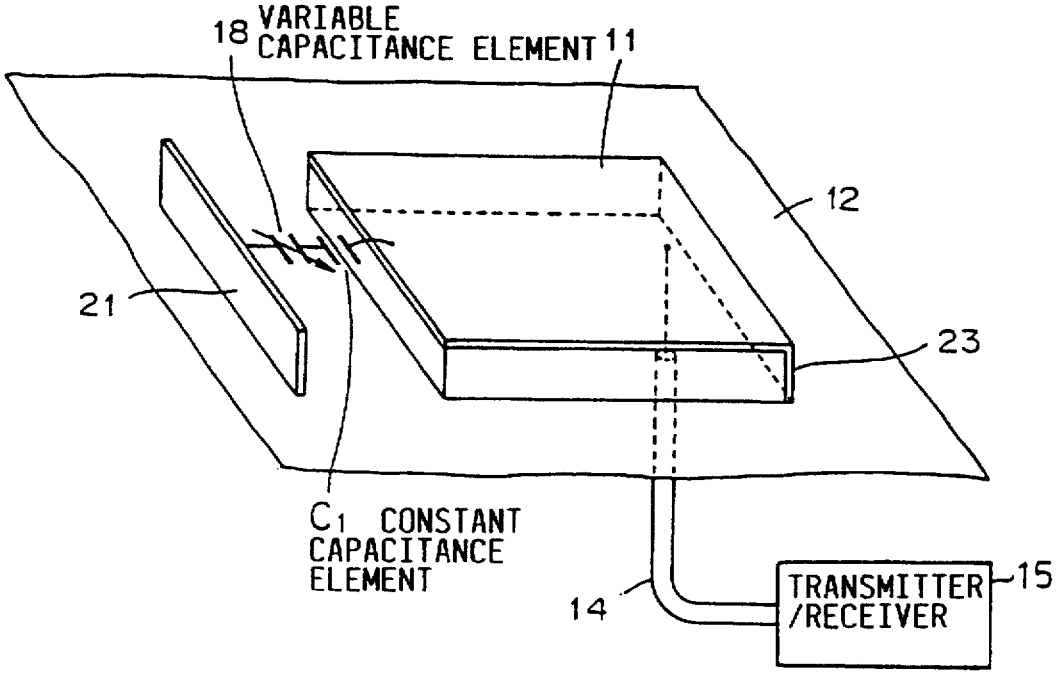
FIG. 13 is a perspective view illustrating another modified form of the FIG. 5 embodiment which has a series connection of a constant capacitance element and a variable capacitance element.

FIG. 12 illustrates an embodiment of the present invention which employs a variable capacitance element 18 as a substitute for the series connection of the capacitor C1 and the switch 16 in the FIG. 10 embodiment, and FIG. 13 illustrates another embodiment which employs a series connection of the variable capacitance element 18 and the fixed capacitor C1 as a substitute for the series connection of the capacitor C1 and the switch 16 in the FIG. 10 embodiment. By making the capacitance of the variable capacitance element 18 variable, the resonance frequency of the antenna can be changed. Thus, the antenna can cover a wide frequency range. Since the radiating patch 11 is shorted by the short-circuit plate 23 to the ground plate 12, both ends of the variable capacitance element 18 are equipotential DC-wise in the FIG. 12 embodiment, and hence no bias voltage can be applied directly across the variable capacitance element 18. Accordingly, a transistor or field effect transistor, for example, can be used as the variable capacitance element 18. That is, by connecting a collector and emitter of the transistor or the drain and source of a field effect transistor to the radiating patch 11 and the ground plate 12, respectively, and then applying a reverse bias voltage to the base or drain, the collector-emitter or drain-source capacitance can be varied.

On the other hand, since in FIG. 13 the variable capacitance element 18 and the constant capacitance element 17 are connected in series to the open end of the radiating patch 11, one terminal of the variable capacitance element 18 is disconnected DC-wise from the ground plate 12 and a bias voltage can be applied directly across the variable capacitance element 18; hence, a variable capacitance diode such as a varicap can be used as the variable capacitance element. As will be seen from the above, the variable capacitance element 18 is not limited specifically to the varicap but may also be some other types of variable capacitance elements.

Thus, a small, high efficiency microstrip antenna device can be realized by adopting such a construction as shown in FIG. 12 or 13. In addition, the resonance frequency of the antenna can be continuously varied by limiting the capacitance of the variable capacitance element 18 with a signal from the transmitter or receiver 15; accordingly, it is possible to realize an antenna which covers a wide frequency range and to always optimize its characteristic for the channel used.

Figure 14A:
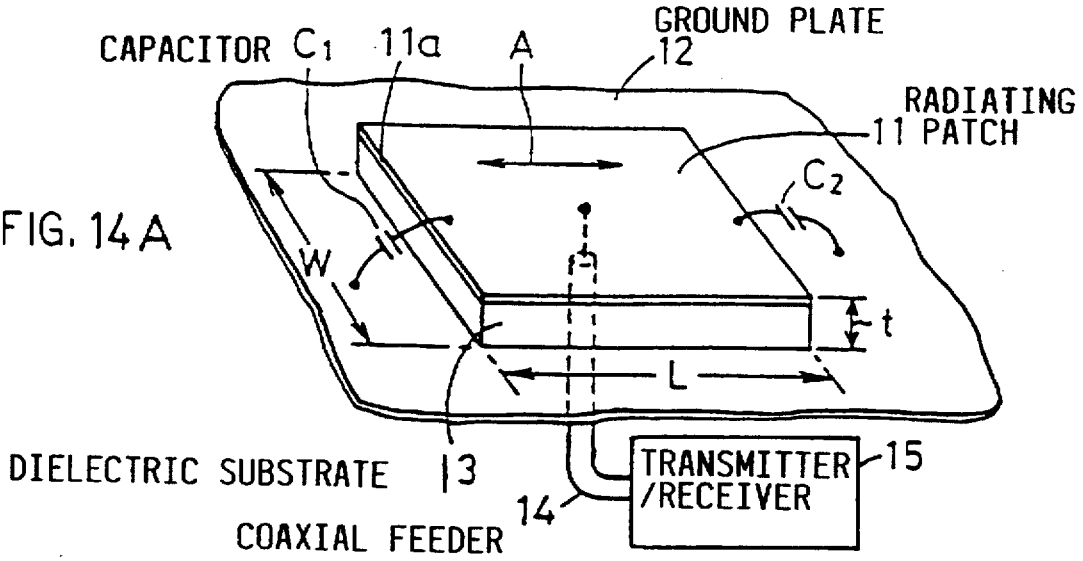
FIG. 14A is a perspective view illustrating another embodiment of the present invention which has capacitors connected to opposite open sides of the radiating patch.

FIG. 14A illustrates another embodiment of the present invention which has capacitors connected to both open ends of the radiating patch 11 instead of equivalently forming the capacitors $C_{E1}$ and $C_{E2}$ by providing the metal plates 21 and 22 in the half-wave microstrip antenna of FIG. 4 embodiment, the parts corresponding to those in FIG. 4 being identified by the same reference numerals. In this embodiment, capacitors $C_1$ and $C_2$ are connected between the opposite marginal edges 11*a* and 11*b* of the radiating patch 11 in the direction of resonance A and the grounding conductor 12. Based on the experimental results mentioned below, the antenna length L, for instance, is selected in the range of between 0.15 to 0.40 λe, preferably between 0.15 to 0.25 λe.

Figure 14B:
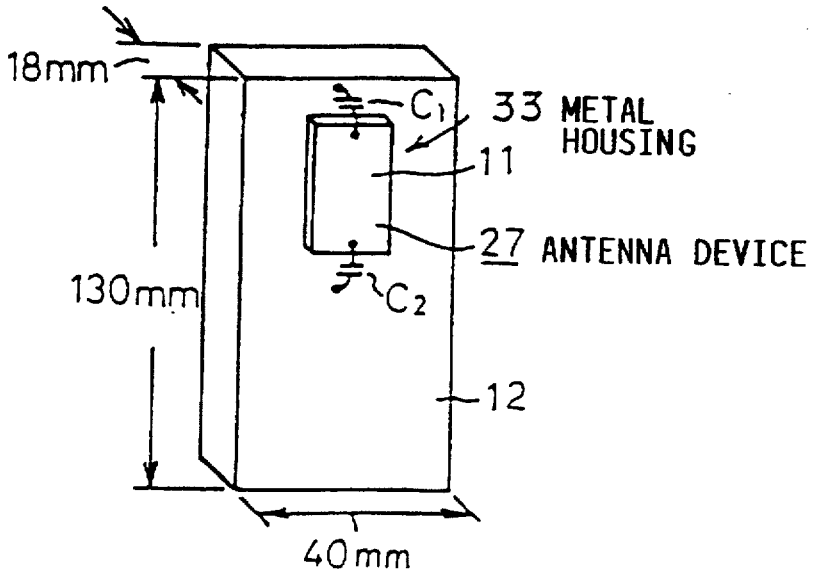
FIG. 14B is a perspective view showing the mounting of the microstrip antenna device of FIG. 14A on a metallic box.
Figure 15A:
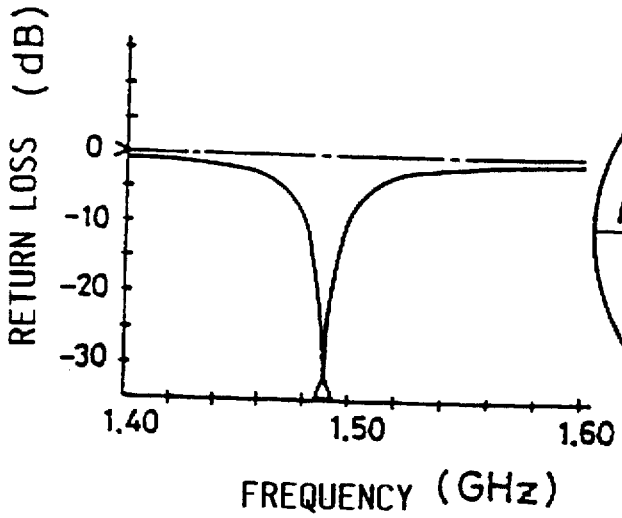
FIG. 15A is a graph showing the return loss characteristic of the FIG. 14A embodiment when the antenna length L is 40 mm.
Figure 15C:
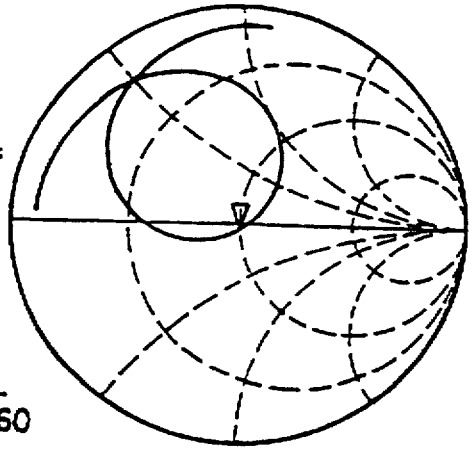
FIG. 15C is a Smith chart showing the impedance characteristic corresponding to the return loss characteristic depicted in FIG. 15A.
Figure 15B:
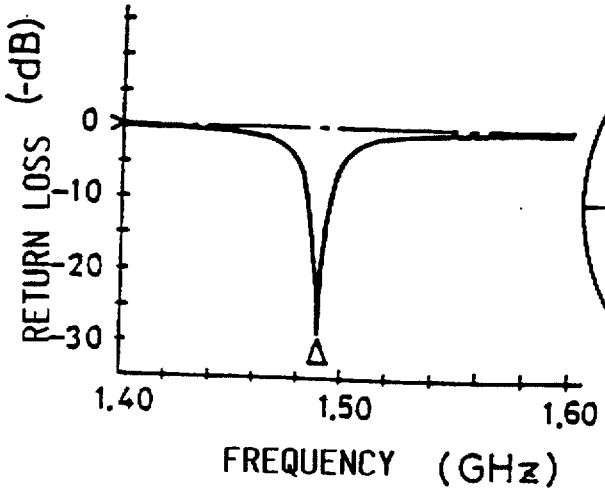
FIG. 15B is a graph showing the return loss characteristic of the FIG. 14A embodiment when the antenna length L is 10 mm.
Figure 15D:
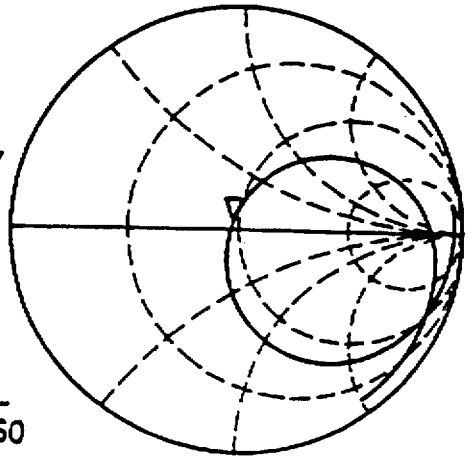
FIG. 15D is a Smith chart showing the impedance characteristic corresponding to the return loss characteristic depicted in FIG. 15B.

A description will be given of experimental results conducted to confirm the effectiveness of the antenna device of the present invention. A plurality of antenna devices were prepared for each of preselected lengths L=10, 20, 30 and 40 mm of the radiating patch 11 in the direction of resonance and the capacitances of the capacitors $C_1$ and $C_2$ were adjusted so that the antenna devices would resonate at 1.49 GHz. In FIG. 14B there is shown the antenna structure on which the experiments were conducted. One of major surfaces of a box-shaped metal housing 33 is held vertical in its lengthwise direction and an antenna device 27 is mounted on the major surface at the center of its upper half portion with the radiating patch 11 secured thereto through the dielectric substrate 13, and the capacitors C1 and C2 are connected between the upper and lower sides of the radiating patch 11 and the above-mentioned major surface of the housing 33 serving as the ground plate 12. The housing 33 is 130 mm in height, 40 mm in width and 18 mm in thickness. The radiating patch 11 has a length L, a width W of 20 mm and a height t of 4.8 mm and the dielectric constant $\epsilon_r$ of the dielectric substrate 13 is 2.6. The capacitances of the capacitors $C_1$ and $C_2$ were adjusted so that the antennas with L=10, 20, 30 and 40 mm would resonate at 1.49 GHz. FIGS. 15A and 15B respectively show return losses when L was equal to 40 mm and 10 mm, and FIGS. 15C and 15D are Smith charts showing the impedance characteristics corresponding to the return losses. It is seen that resonance was established accurately at f=1.49 GHz in either case.

Figure 16A:
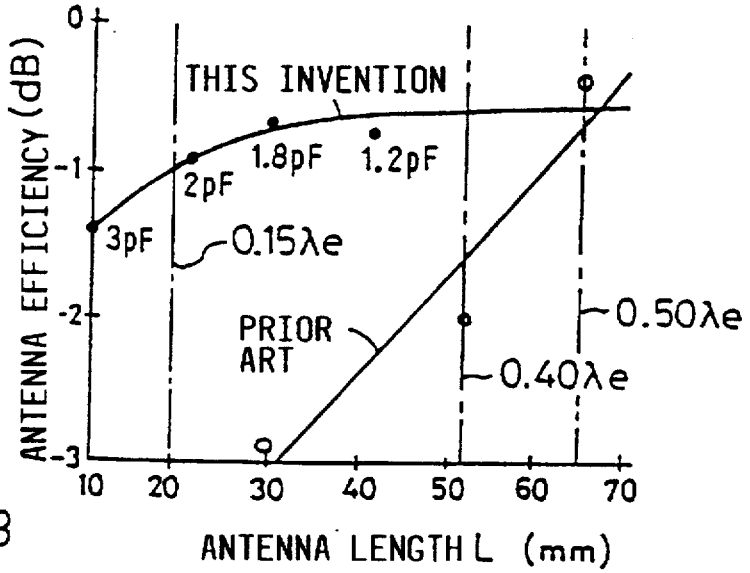
FIG. 16A is a graph showing the relationship between the antenna length and the antenna efficiency.

In FIG. 16A there is shown the relationship between the antenna length L and the antenna efficiency in the antennas. The four pieces of data indicated by black circles show the antenna efficiency when the capacitors $C_1$ and $C_2$ were added, and their capacitance values adjusted to obtain the resonance frequency of 1.49 GHz were 3.0, 2.0, 1.8 and 1.2 pF (each of which is an average value for the plurality of antennas) when the antenna lengths were 10, 20, 30 and 40 mm, respectively. White circles indicate pieces of data which show the relationship between the antenna length L and the antenna efficiency when the dielectric constant of the dielectric substrate 13 was increased and the antenna length L reduced in the prior art example of FIG. 1. In the conventional antenna device, the dielectric constant $\epsilon_r$ of the dielectric substrate 13 was set at 2.6, 3.6 and 17.0 when the antenna length L was 65, 52 and 30 mm, respectively. Letting the guide wavelength in the antenna be represented by λe, it will be seen from FIG. 16A that even if the antenna length L is 52 mm (0.4 λe), the antenna device of the present invention is efficient more than 1 dB as compared with the prior art example. Further, when the dielectric substrate 13 of the conventional antenna device shown in FIG. 1 is formed of a low-loss dielectric material ($\epsilon_r$=2.6), the antenna efficiency can be raised more than −1 dB but the antenna length L increases to 65 mm as shown in FIG. 16A.

As depicted in FIG. 16A, the antenna length L can be decreased as the capacitances of the capacitors connected to the radiating patch 11 is increased with a view to reducing the antenna length L according to the principle of the present invention, but when the antenna length is smaller than 0.15 λe, the antenna efficiency will be lower than −1 dB. To attain an antenna efficiency above −1 dB, it is necessary in the antenna device of the present invention that the antenna length L be larger than 19.5 mm (0.15 λe). On the other hand, the present invention is aimed at the miniaturization of the antenna by connecting a capacitance to the radiating patch, and if the aim is to miniaturize the antenna down to 80% or more, the target antenna length L is smaller than 0.4 λe in the FIG. 14A embodiment of the half-wave antenna. Hence, it can be said that the antenna device of the present invention is effective when the length L of the radiating patch 11 is in the range from 0.40 to 0.15 λe. With the antenna device of the present invention, if the antenna length L is set at about 0.25 λe, the antenna efficiency is improved approximately 2 dB as compared with the enhancement by the reduction of the antenna length by increasing the dielectric constant of the dielectric substrate 13, and when the antenna length L is set at about 0.2 λe, the antenna efficiency is further raised.

Figure 16B:
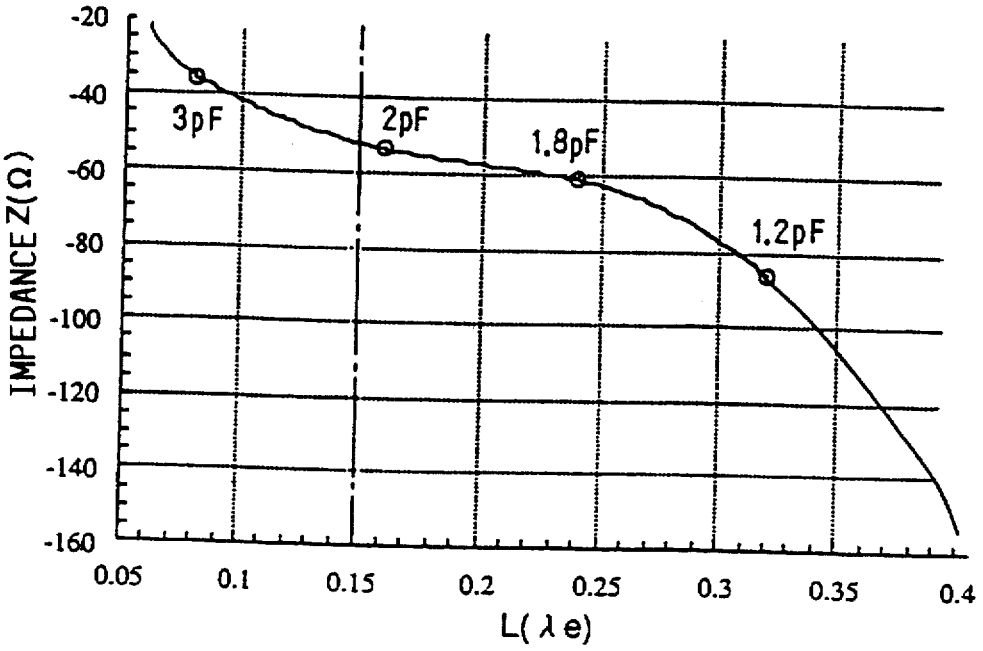
FIG. 16B is a graph showing the relationship between the impedance of an added capacitor and the antenna length when the resonance frequency is fixed.

FIG. 16B is a graph in which the relationship between the additional capacitance value in FIG. 16A for establishing resonance at 1.49 GHz, measured for the FIG. 14 embodiment, and the corresponding antenna length L is shown in terms of the relationship between the impedance $\frac{1}{2\pi f_r C}$ (where $f_r$ is the antenna resonance frequency, which is assumed to be 1.49 GHz in this example) and the antenna length (the length normalized by λe). Applying to this graph the preferable range of the antenna length from 0.15 to 0.40 λe mentioned above with respect to FIG. 16A, it will be seen that the impedance $\frac{1}{2\pi f_r C}$ of the additional capacitance may preferably be in the range of −50 to −150 Ω.

Figure 17:
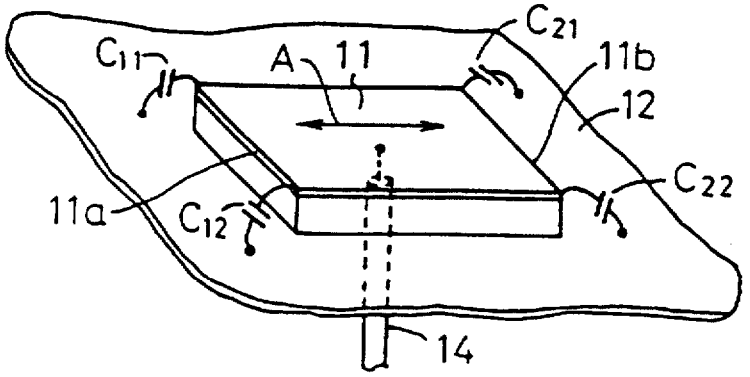
FIG. 17 is a perspective view illustrating another embodiment of the half-wave microstrip antenna device of the present invention which has capacitors at four corners of the radiating patch.

In the embodiment of FIG. 14A, capacitors $C_{11}$, $C_{12}$, $C_{21}$ and $C_{22}$ may be connected between four corners of the radiating patch 11 and the ground plate 12 in place of the two capacitors $C_1$ and $C_2$ as shown in FIG. 17. By connecting a plurality of capacitors to the radiating patch at a distance from one another along the marginal edges 11*a* and 11*b* thereof as mentioned above, the current distribution in a direction at right angles to the direction of resonance A is made uniform and the antenna efficiency can be enhanced.

Figure 18A:
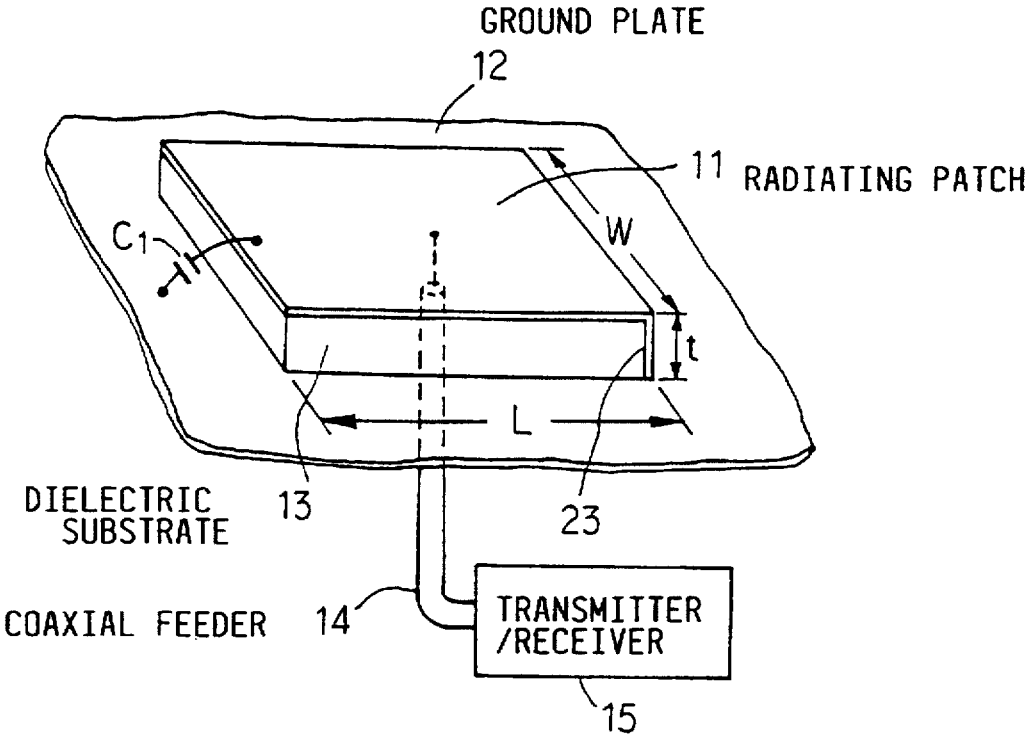
FIG. 18A is a perspective view illustrating another embodiment of the quarter-wave microstrip antenna device of the present invention which has a capacitor additionally disposed at an open end of the radiating patch.

FIG. 18A illustrates another embodiment employs the capacitor $C_1$ as in the FIG. 14A embodiment instead of forming the capacitance $C_E$ by the metal plate in the quarter-wave antenna of FIG. 5, the parts corresponding to those in FIG. 14A being identified by the same reference numerals. Since the antenna of this embodiment is a quarter-wave antenna, the length L of the radiating patch 11 is made about one-half that in the case of FIG. 14A and one side of the radiating patch 11 is shorted to the ground plate 12 by the short-circuit plate 23. The inner conductor 14C of the coaxial feeder 14 is connected to the radiating patch 11 near the short-circuit plate 23. Since the microstrip antenna performs the same operation as in the case of FIG. 14A on the basis of an image that is produced on the ground plate 12, it is considered that the capacitor $C_1$ in the FIG. 18A embodiment produces exactly the same effect as does the additional capacitor $C_1$ in FIG. 14A. In this case, however, since the length L of the radiating patch 11 is cut in half, the antenna length L is in the range of 0.075 to 0.20 λe, preferably in the range of 0.075 to 0.125 λe. The capacitor $C_1$ is connected only to the open end marginal edge of the radiating patch on the side opposite to the short-circuit plate 23.

Figure 18B:
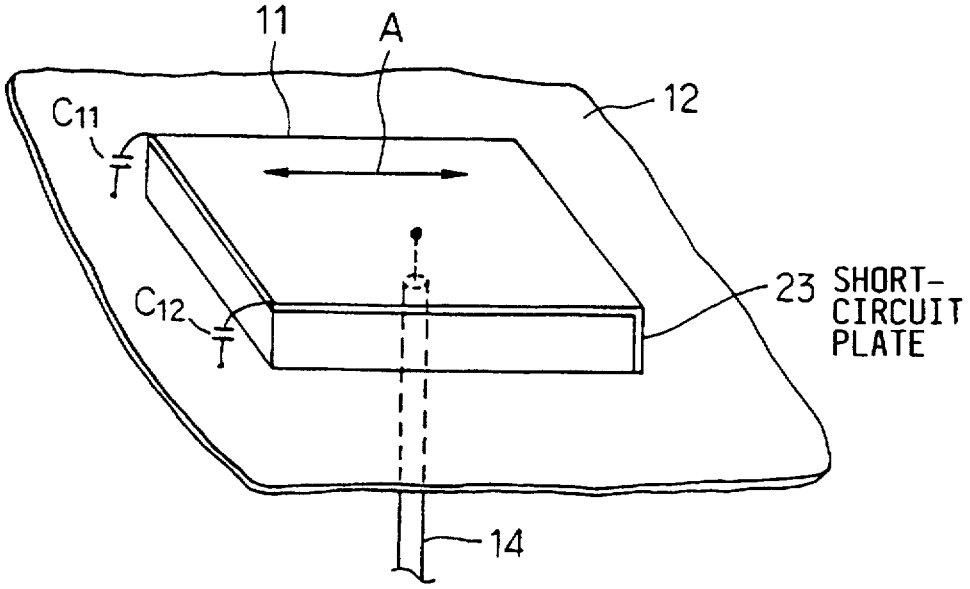
FIG. 18B is a perspective view illustrating another embodiment of the quarter-wave microstrip antenna device of the present invention which has two capacitors.

In this instance, the capacitors $C_{11}$ and $C_{12}$ may also be connected to both ends of the open end marginal edge of the radiating patch 11 on the side opposite to the short-circuit plate 23 as shown in FIG. 18B. With the capacitors thus connected to both ends of the open end marginal edge of the radiating patch 11, current is distributed more uniformly all over the radiating patch—this decreases copper loss and hence further increases the antenna efficiency.

As is the case with the antenna device of FIG. 14A, the housing 33 shown in FIG. 14B was used to experiment with the antenna device of FIG. 18A. The antenna device was mounted on the housing with the short-circuit plate 23 held in the vertical direction. The frequency f for experiment was 814 MHz and a quarter-wave antenna was constructed with an antenna length L of 28 mm, an antenna width W of 25 mm and an antenna height of 4.8 mm. It was found experimentally that the antenna efficiency of the FIG. 18B structure was 0.4 dB higher than the antenna efficiency of the structure depicted in FIG. 18A. Thus, the antenna structure with a plurality of capacitors provides increased antenna efficiency.

Also in the half-wave antenna, when two or more capacitors are connected to each of the two marginal edges 11*a* and 11*b* at separate places across the direction of resonance A as shown in FIG. 17, the current distribution all over the radiating patch 11 becomes uniform as is the case with FIG. 18B. It is also possible, however, to adopt a structure in which the capacitors $C_{11}$, and $C_{12}$, for instance, are left intact, one of the capacitors $C_{21}$ and $C_{22}$ is omitted and the other is connected to the marginal edge of the radiating patch at any given position. Similarly, also in any of the embodiments of FIGS. 14A, 18A and 18B, an arbitrary number of capacitors may be connected between the radiating patch 11 and the ground plate 12 at any arbitrary positions as long as the capacitors are connected to the open end marginal edges of the radiating patch in the direction of resonance.

Figure 19:
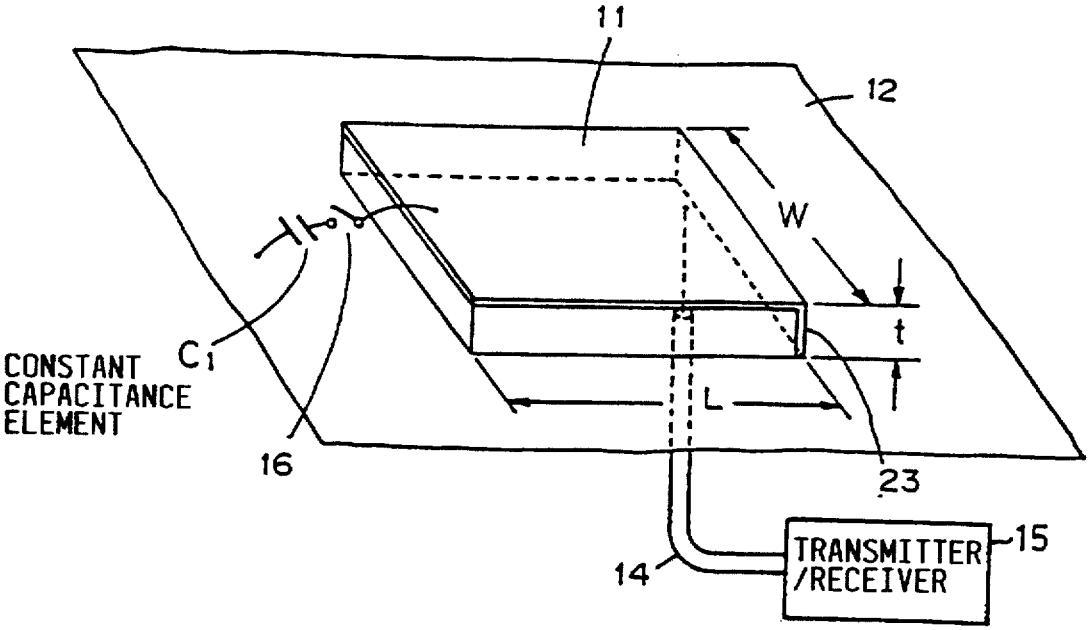
FIG. 19 is a perspective view illustrating another embodiment of the quarter-wave microstrip antenna device of the present invention which has a series connection of a capacitor and a switch at an open end of the radiating patch.

FIG. 19 illustrates another embodiment of the present invention which uses the series connection of the fixed capacitance capacitor $C_1$ and the switch 16 in the FIG. 10 embodiment as a substitute for the capacitor $C_1$ in the FIG. 18A embodiment. When the switch 16 is held OFF, the capacitor $C_1$ is disconnected from the radiating patch 11 and the antenna resonates at a high frequency, whereas when the switch 16 is held ON, the capacitor $C_1$ is connected to the radiating patch 11 and the antenna resonates at a low frequency. While the antenna is switched between two resonance frequencies in the embodiment of FIG. 19, it can also be switched between three or more resonance frequencies by providing a plurality of series connections of capacitors $C_1$ and switches 16.

Figure 20:
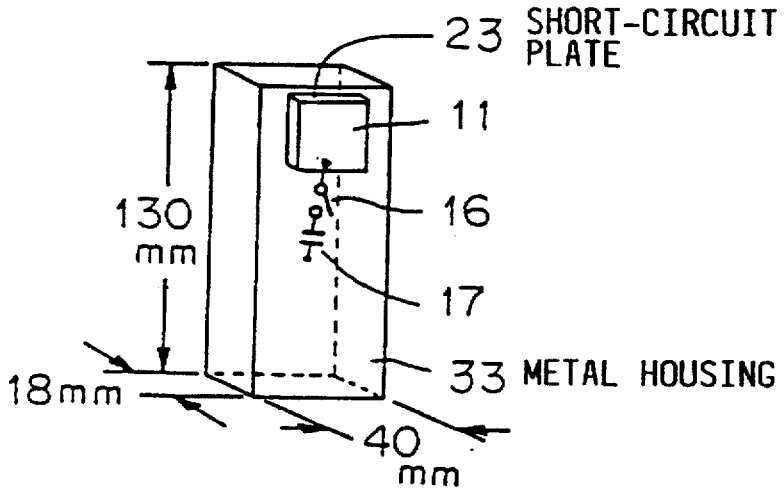
FIG. 20 is a perspective view showing the mounting of the microstrip antenna device of FIG. 19 on the metallic box.
Figure 21A:
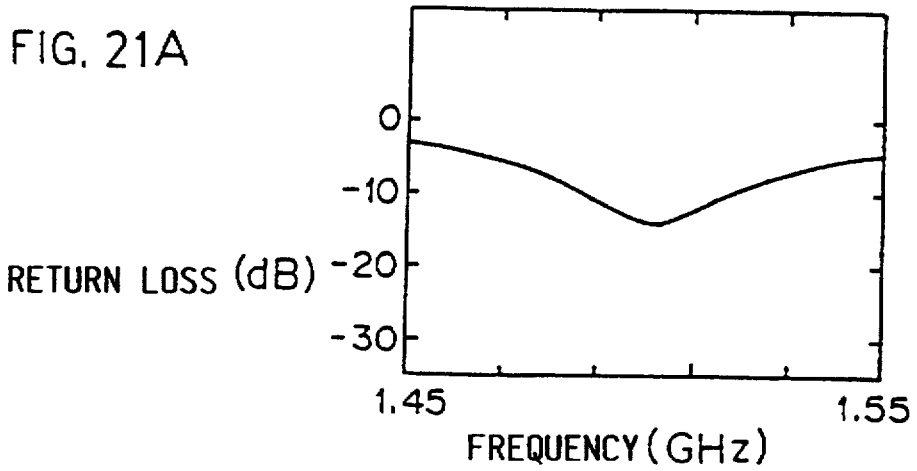
FIG. 21A is a characteristic diagram for explaining the resonance characteristic of the microstrip antenna device measured in the experiment of FIG. 20.
Figure 21B:
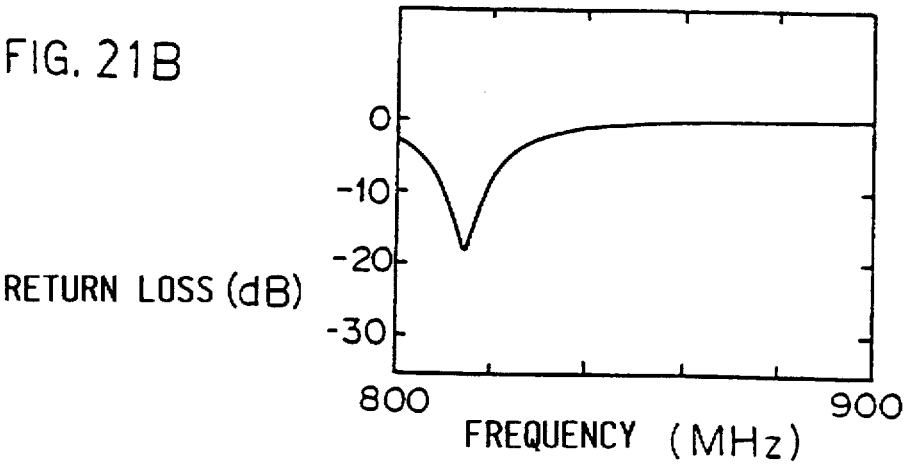
FIG. 21B is a characteristic diagram for explaining the resonance characteristic of the microstrip antenna device measured in the experiment of FIG. 20.

As shown in FIG. 20, the metal housing 33 was used to experiment with the antenna of FIG. 19. The dimensions of the antenna were L=30 mm, W=25 mm and t=4.8 mm, the dielectric constant $\epsilon_r$ of the dielectric substrate was 2.6 and the capacitance of the capacitor $C_1$ was 4 pF. With the switch 16 held OFF, the antenna resonates at about 1.5 GHz as shown in FIG. 21A, and with the switch 16 held ON, the antenna resonates at about 815 MHz as shown in FIG. 21B. Thus, the antenna can be made to resonate at a selected one of the two frequencies by switching of the switch 16. Other effects by this embodiment are the same as those by the other embodiments.

Figure 22:
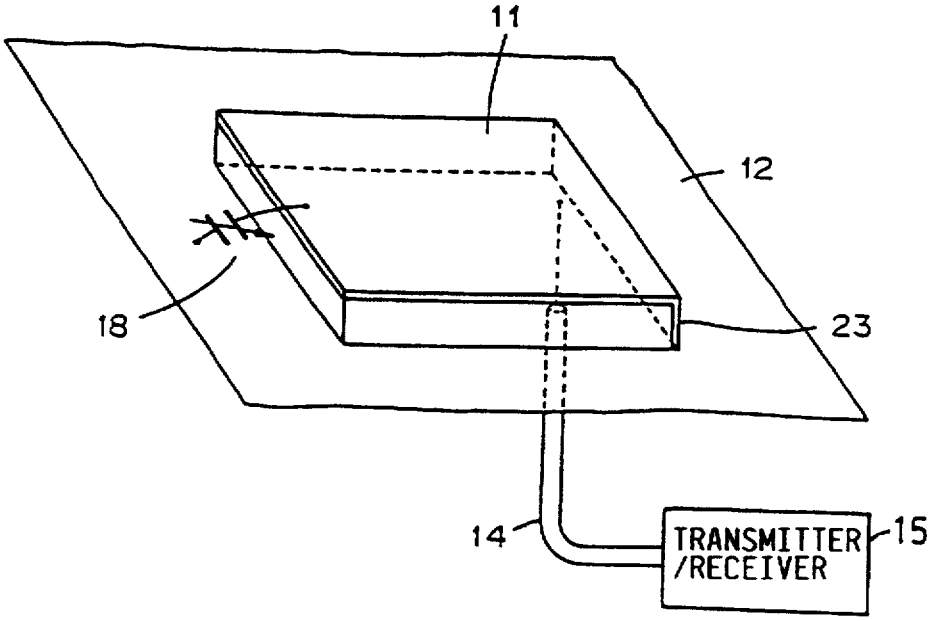
FIG. 22 is a perspective view illustrating another embodiment of the quarter-wave microstrip antenna device of the present invention which has a variable capacitance element.
Figure 23:
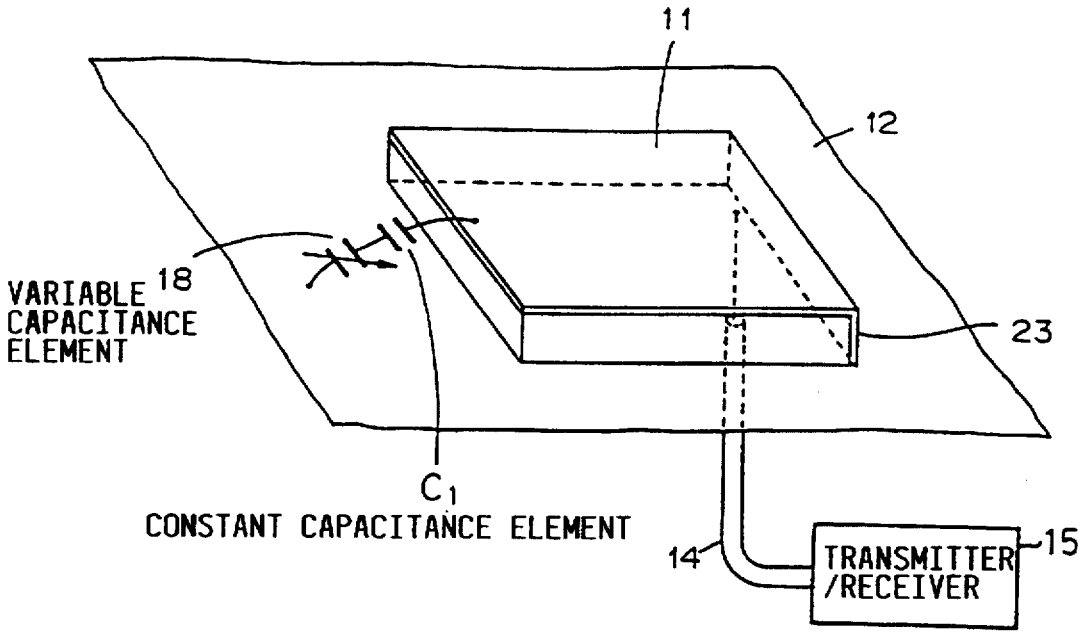
FIG. 23 is a perspective view illustrating another embodiment of the quarter-wave microstrip antenna device of the present invention which has a series connection of a constant capacitance element and a variable capacitance element.

FIGS. 22 and 23 illustrate embodiments which replace the capacitor $C_1$ in the FIG. 18A embodiment with the variable capacitance element 18 in FIG. 12 and with the series connection of the fixed capacitance capacitor $C_1$ and the variable capacitance element 18 in FIG. 13, respectively. That is, these embodiments make it possible to change the resonance frequency of the antenna through the use of the variable capacitance element 18 and hence cover a wide frequency range. Since one marginal edge of the radiating patch 11 is shorted to the ground plate 12 by the short-circuit plate 23, the opposite ends of the variable capacitance element 18 are equipotential DC-wise in the FIG. 22 embodiment, in which case, however, the capacitance between the marginal edge of the radiating patch 11 and the ground plate 12 can be changed through the use of a transistor or field effect transistor as the variable capacitance element 18.

On the other hand, since the variable capacitance element 18 and the constant capacitance element $C_1$ are connected in series to the open end marginal edge of the radiating patch 11 in the FIG. 23 embodiment, the variable capacitance element is disconnected DC-wise at one end from the radiating patch 11 and the ground plate 12 and, consequently, a DC bias can be applied directly to the variable capacitance element 18.

With such structures as depicted in FIGS. 19, 22 and 23, the resonance frequency can be varied continuously by controlling the capacitance of the variable capacitance element 18 with a signal from the transmitter or receiver 15; hence, it is possible to obtain an antenna capable of covering a wide frequency range and adjustable for an optimum characteristic for the channel used.

Figure 3:
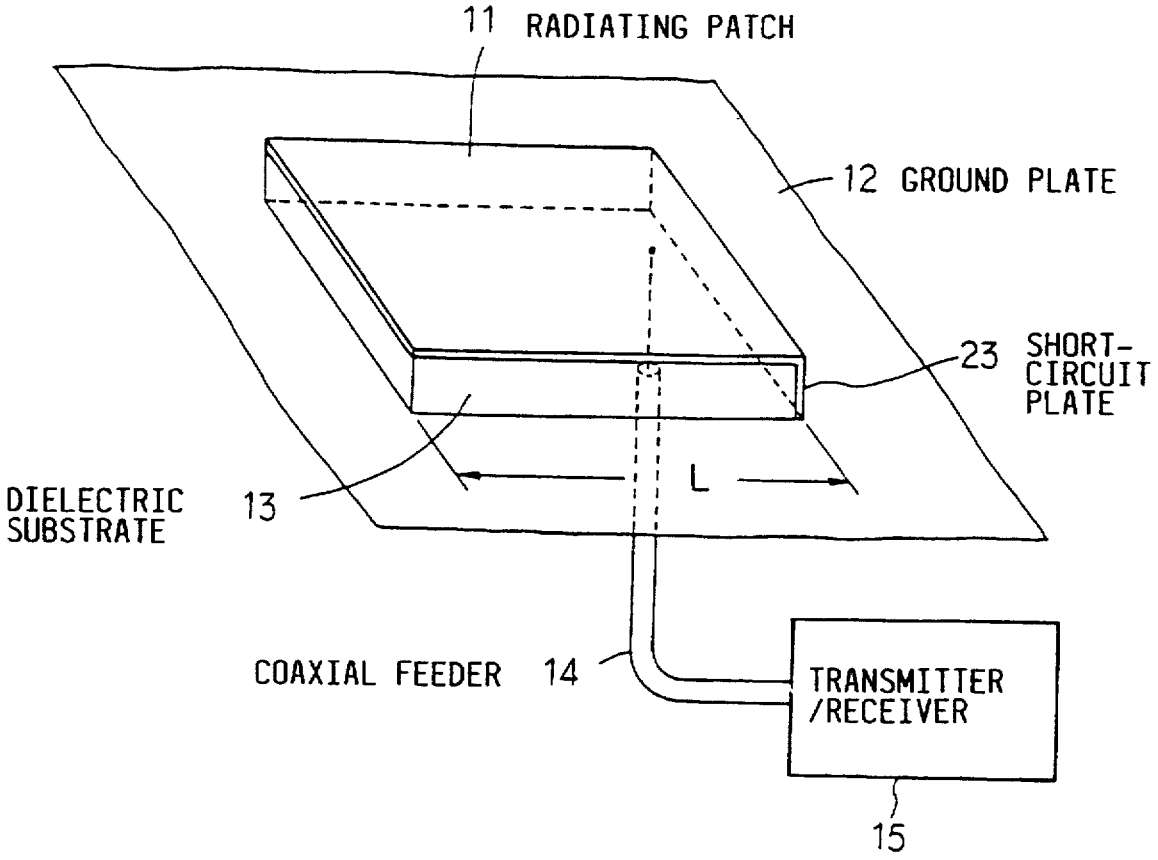
FIG. 3 PRIOR ART
FIG. 3 is a perspective view showing another prior art example.
Figure 24:
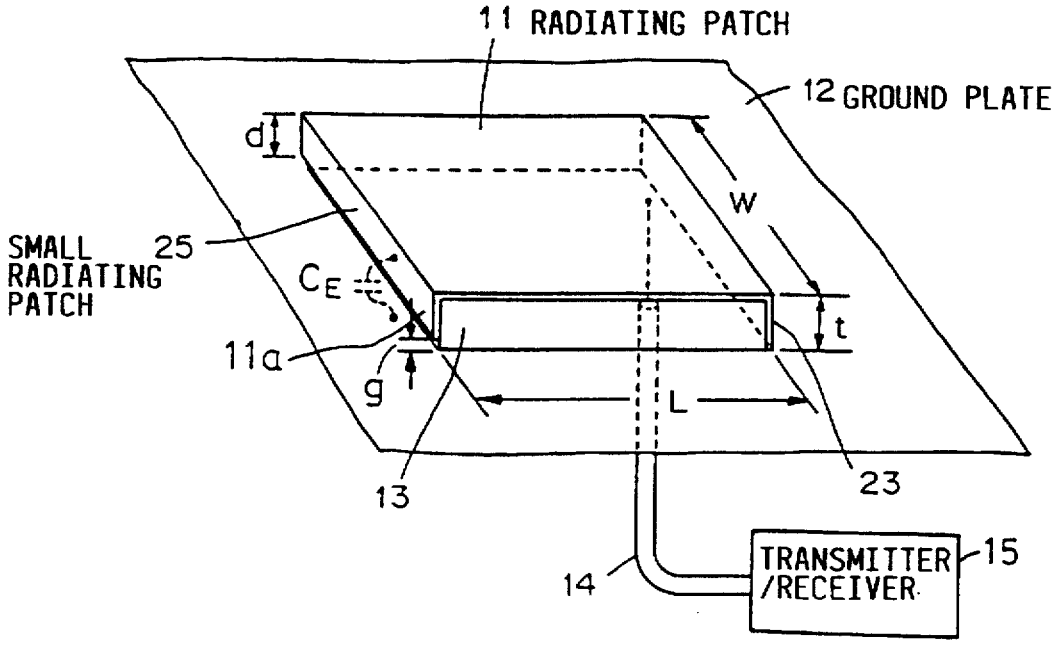
FIG. 24 is a perspective view illustrating another embodiment of the quarter-wave microstrip antenna device of the present invention which has a capacitance formed by bending the open end of the radiating patch.

FIG. 24 illustrates a modified form of the FIG. 5 embodiment, in which the capacitor $C_E$ is formed by bending down the marginal portion of the radiating patch 11 along the marginal edge 11*a* at right angles toward the ground plate 12 to form a small or auxiliary radiating patch 25 separated by a gap g=t−d from the ground plate 12, instead of planting the metal plate 21. In FIG. 24 the parts corresponding to those in FIG. 5 are identified by the same reference numerals. With the conventional microstrip antenna, the resonance wavelength depends on the length L of the radiating patch 11 (see FIG. 3). With the structure shown in FIG. 24, the resonance wavelength is dependent on the sum (L+d) of the length L of the radiating patch 11 and the length d of the small radiating patch 25 and, accordingly, if the same resonance frequency is used, the provision of the small radiating patch 25 could make the antenna length L shorter. Further, since the capacitor $C_E$ is defined between the marginal edge of the small radiating patch 25 and the ground plate, the antenna length can be reduced by this as well. By these two effects, the antenna length can be made shorter than the length $\lambda/4\sqrt{\epsilon_r}$ (where $\epsilon_r$ is the dielectric constant of the dielectric material) needed in the conventional quarter-wave microstrip antenna, and since the capacitance coupling portion has a high Q, the antenna efficiency will not decrease.

Figure 25A:
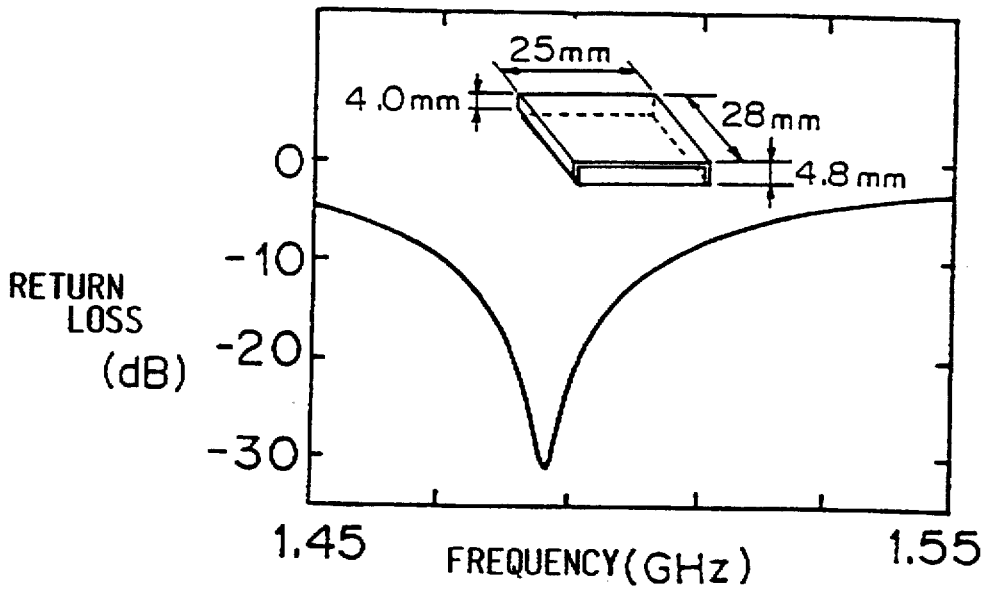
FIG. 25A is a characteristic diagram for explaining the resonance characteristic of the quarter-wave microstrip antenna device of FIG. 24.
Figure 25B:
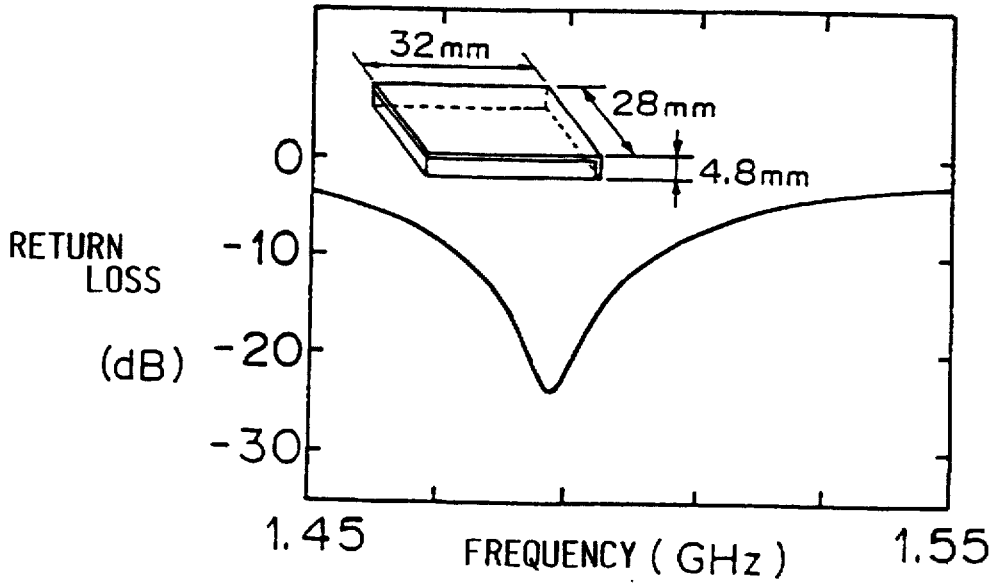
FIG. 25B is a characteristic diagram for explaining the resonance characteristic of a conventional quarter-wave microstrip antenna device.

Experiments were carried out on the antenna of the FIG. 24 structure which was mounted on a metal housing having a size of 130 by 40 by 180 mm. In the structure of FIG. 24, L=25 mm, W=28 mm, t=4.8 mm d=4 mm and a dielectric material of a dielectric constant $\epsilon_r$=2.6 was used. In FIG. 25A there is shown the return loss measured. As depicted in FIG. 25A, resonance can be established at a frequency of about 1.49 GHz. On the other hand, the conventional quarter-wave microstrip antenna (FIG. 3) can also resonate at 1.49 GHz or so by using the dielectric material of the dielectric constant $\epsilon_r$=2.6 and the antenna length L of about 32 mm (see FIG. 25B). That is, to say, it will be seen that the structure of FIG. 24 reduces the antenna length L from 32 mm down to 25 mm and hence permits a reduction of around 78%. Moreover, in the embodiment of FIG. 24, L+d=29 mm, 3 mm smaller than the value 32 mm in FIG. 25B. This is considered to be the effect by the capacitance formed between the radiating end of the radiating patch 11 and the ground plate 12. The antenna efficiency of either of the antennas shown in FIGS. 25A and 25B is high and fall in the range of 0 to −0.5 dB. Thus, the antenna structure of this embodiment can be made smaller than in the past while holding a high antenna efficiency.

Figure 26:
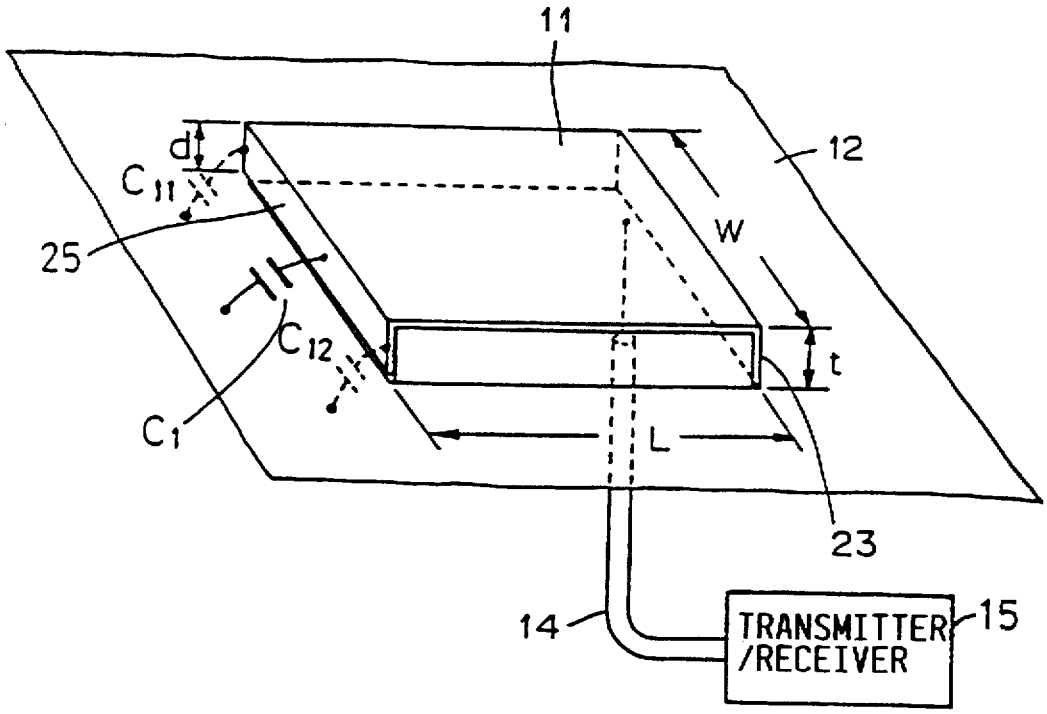
FIG. 26 is a perspective view illustrating a modified form of the FIG. 24 embodiment which has a constant capacitance element added to a small radiating conductor.

FIG. 26 illustrates a modified form of the FIG. 24 embodiment, in which the constant capacitance element $C_1$ is added to the small radiating patch 25. The antenna structure of this embodiment is intended to resonate at lower frequencies by connecting the constant capacitance element $C_1$ between the small radiating patch 25 and the ground plate 12 and using the same size as the antenna of FIG. 24. The use of a high-Q capacitor as the constant capacitance element $C_1$ permits further miniaturization of the antenna without impairing the antenna efficiency.

Figure 27:
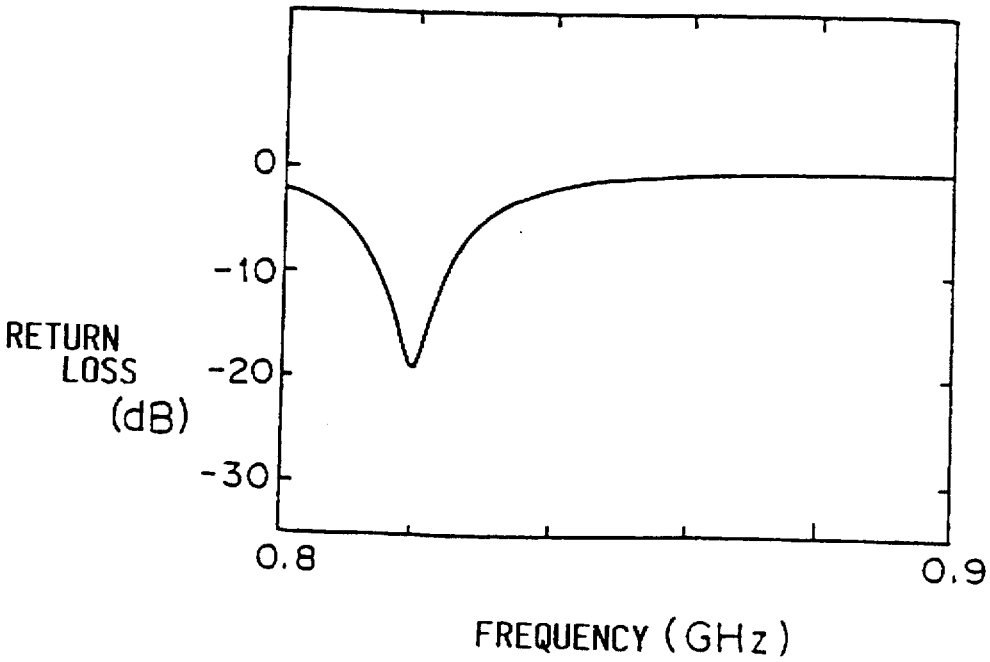
FIG. 27 is a characteristic diagram for explaining the resonance characteristic of the microstrip antenna device of FIG. 26.

Experiments were conducted on the antenna of the FIG. 26 structure which was mounted on a metal housing having a size of 130 by 40 by 180 mm, for instance. As in the case of FIG. 24, L=25 mm, W=28 mm, t=4.8 mm, d=4 mm, the dielectric constant $\epsilon_r$ of the dielectric material used was 2.6 and a capacitor of a 2-pF capacitance was used as the constant capacitance element $C_1$. FIG. 27 shows the return loss in this example. The resonance frequency f is about 820 MHz. On the other hand, the conventional microstrip antenna (FIG. 3) can also be made to resonate at around 820 MHz when the dielectric constant $\epsilon_r$ of the dielectric material is 2.6 and the antenna length L around 60 mm. That is, the antenna length L is reduced from 60 mm to 25 mm, a reduction of approximately 42%. Thus, it will be seen that the structure permits greater miniaturization of the antenna than the structure of FIG. 24 and hence a significant miniaturization as compared with the conventional structure. As is the case with the embodiments of FIGS. 9 and 18B, the embodiment of FIG. 26 may also employ, as a substitute for the capacitor C1, two capacitors $C_{11}$ and $C_{12}$, for example, which are connected between opposite ends of the small radiating patch 25 in its lengthwise direction and the ground plate 12 as indicated by the broken lines.

Figure 28:
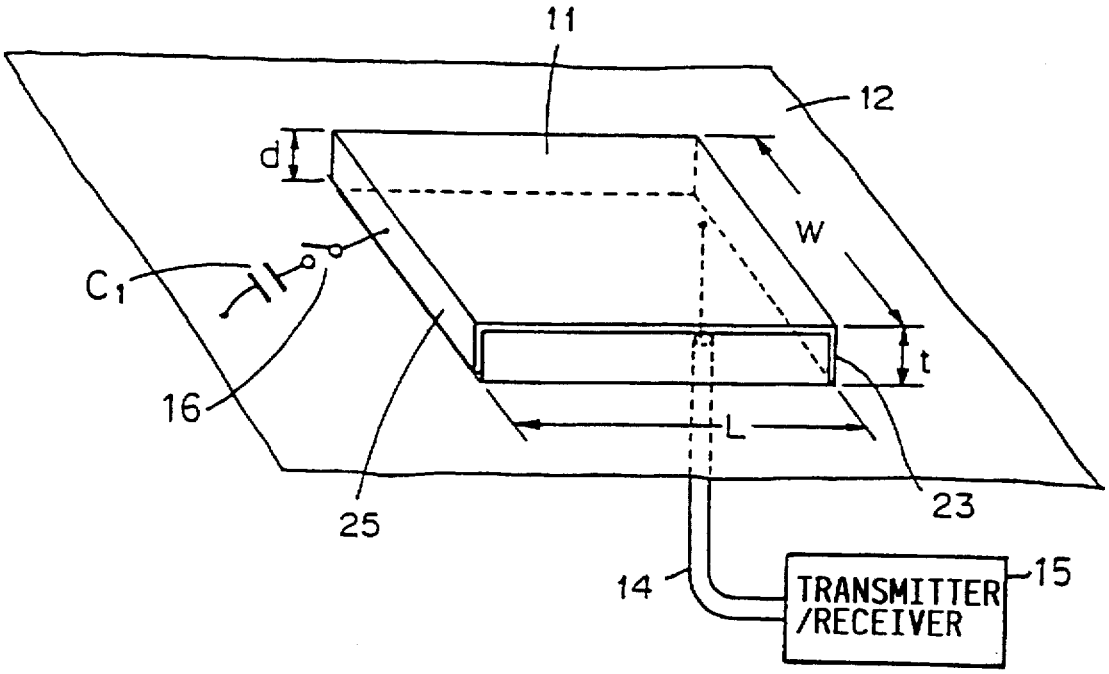
FIG. 28 is a perspective view illustrating another modified form of the FIG. 24 embodiment which has a series connection of a constant capacitance element and a switch.

FIG. 28 illustrates a modified form of the FIG. 24 embodiment, which employs a series connection of the capacitor $C_1$ and the switch 16 as in the embodiment of FIG. 19. The switch 16 is an electronic or mechanical switch, which can be turned ON and OFF electronically or mechanically. When the switch 16 is in the OFF state, the capacitor $C_1$ is disconnected from the radiating patch and the antenna resonates at a high frequency, and when the switch 16 is in the ON state, the capacitor $C_1$ is connected to the radiating patch and the antenna resonates at a low frequency. While in the case of FIG. 28 the antenna resonates at two frequencies, it can be made to resonate at three or more frequencies by increasing the number of series connections of the capacitor $C_1$ and the switch 16.

Experiments were carried out on the antenna of FIG. 28 which was mounted on the metal housing 33 having a size of 130 by 40 by 180 mm. The dimensions of the antenna were the same as those in the cases of FIGS. 24 and 26, that is, L=25 mm, W=28 mm, t=4.8 mm and d=4 mm. The dielectric constant $\epsilon_r$ of the dielectric material was 2.6 and a 2-pF capacitor was used as the constant capacitance element $C_1$. With the switch 16 held OFF, the antenna resonates at a frequency of 1.49 GHz as shown in FIG. 25A and when the switch 16 is held ON, the antenna resonates at 820 MHz as shown in FIG. 27.

Figure 29A:
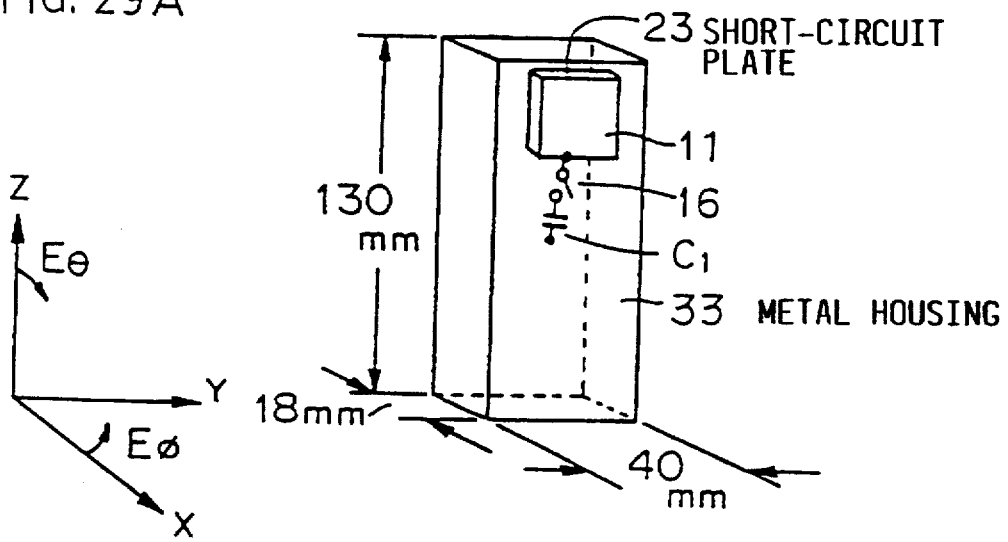
FIG. 29A is a perspective view showing the mounting of the microstrip antenna device of FIG. 28 on the metal housing.
Figure 29B:
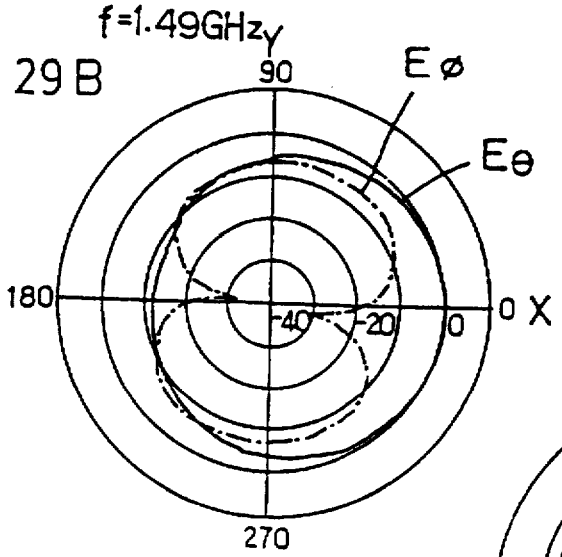
FIG. 29B is a characteristic diagram showing the radiation characteristic of the microstrip antenna device in the experiment of FIG. 29A.
Figure 29C:
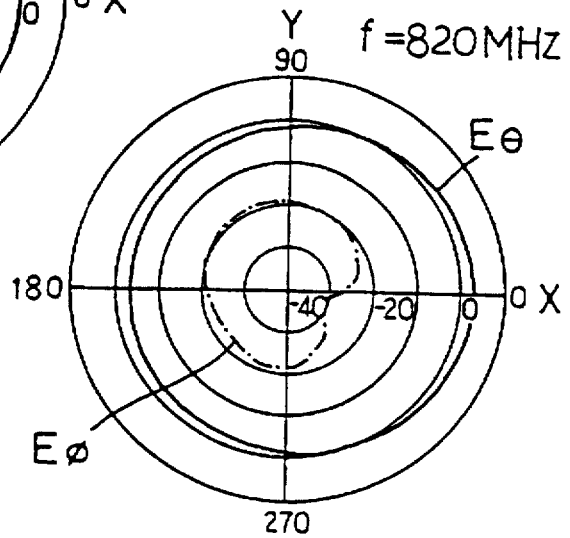
FIG. 29C is a characteristic diagram showing the radiation characteristic of the microstrip antenna device in the experiment of FIG. 29A

In FIGS. 29B and 29C there are shown radiation patterns in the above cases. The radiation patterns of the antenna were measured with the short-circuit plate 23 held upward as depicted in FIG. 29A. Reference numeral 11 denotes a radiating patch and 33 a metal housing. FIG. 29B shows the radiation pattern when f=1.49 GHz and FIG. 29C the radiation pattern when f=820 MHz. In either case, the antenna emits intense radiation in the direction of its front (in the X-axis direction) and there is no difference in antenna efficiency by the frequency difference. The antenna efficiency in either case falls within a range as high as 0 to −0.58 dB. Hence, the antenna of the FIG. 28 embodiment has the advantages of small size, high efficiency and two resonance frequencies.

Figure 30A:
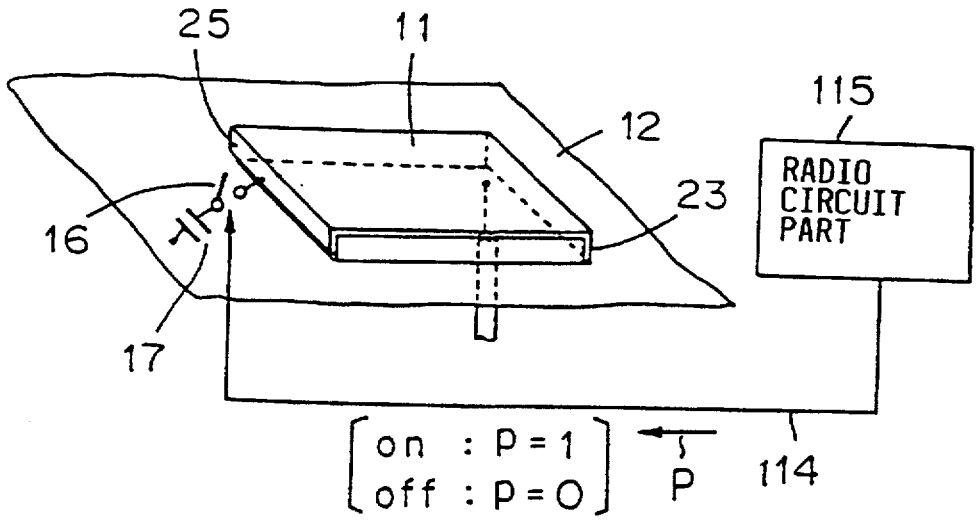
FIG. 30A is a diagram for explaining how to control the resonance frequency of the microstrip antenna device of FIG. 29A.
Figure 30B:
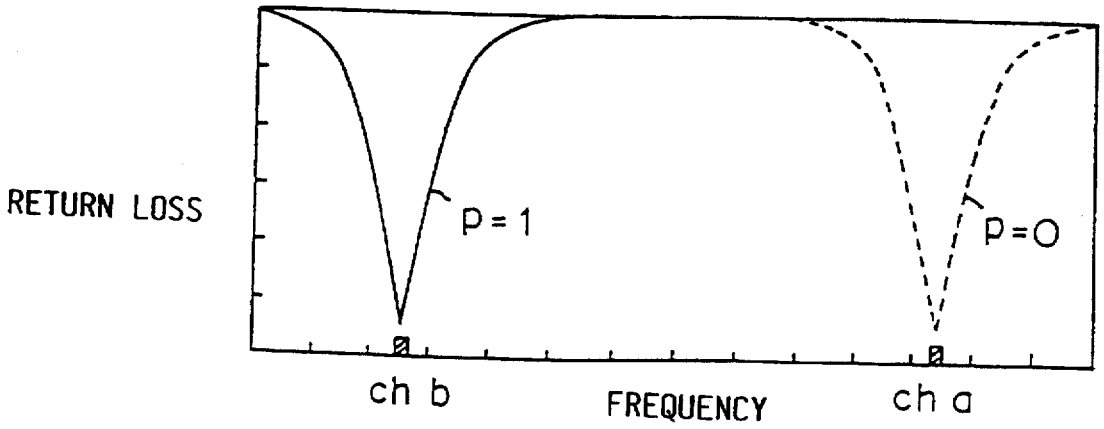
FIG. 30B is a characteristic diagram for explaining how the resonance frequency varies when switched by a switch.

FIG. 30A illustrates an antenna structure wherein the switch 16 is electronically switched, and FIG. 30B shows the antenna characteristic of the illustrated structure. Reference numeral 114 denotes a control signal line, 115 a radio circuit part and P a channel control signal. As depicted in FIG. 30A, the switch 16 of the antenna is controlled by the channel control signal P from the radio circuit part 115. The switch 16 is formed by an electronic switch which is OFF when P=0 and ON when P=1, and the channel control signal P is switched. The antenna resonance frequency changes accordingly as shown in FIG. 30B. When a channel a is used, the control signal P is made a "0", that is, the switch 16 is turned OFF, and optimum resonance is produced at a frequency at that time. On the other hand, when a channel b is used, the control signal P is made a "1" to turn ON the switch 16, similarly producing optimum resonance at a frequency at that time. With such a structure, the switch can be controlled electronically from the radio circuit part 115 according to the frequency used, ensuring the optimum antenna characteristic at all times.

Figure 31:
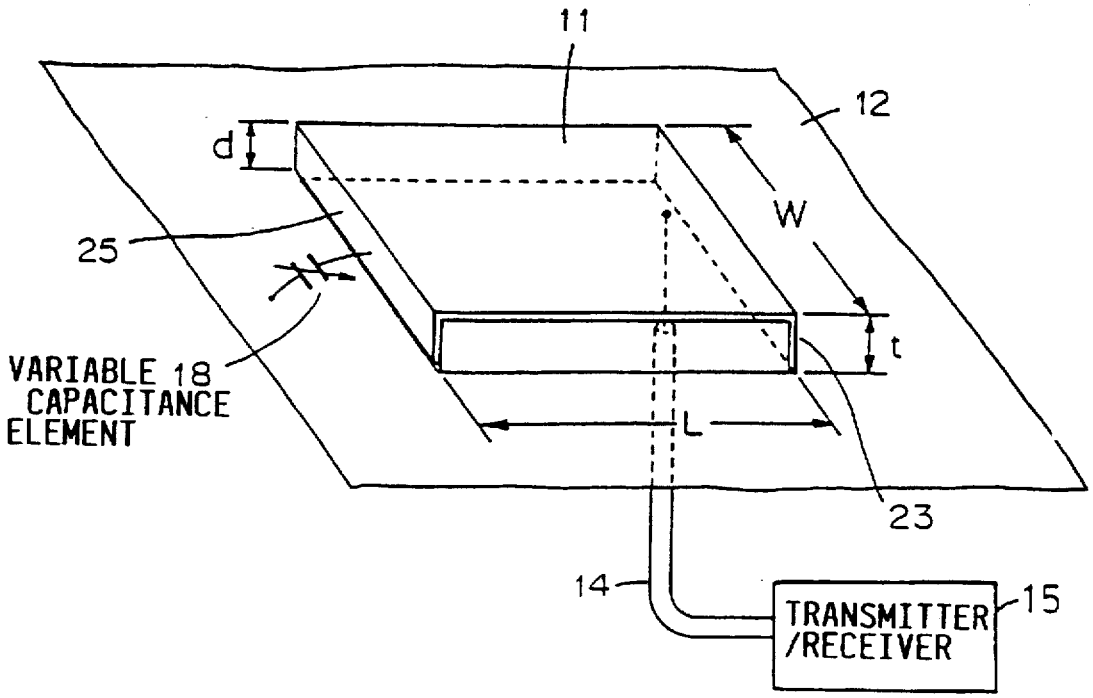
FIG. 31 is a perspective view illustrating another modified form of the FIG. 24 embodiment which has an additional variable capacitance.
Figure 32:
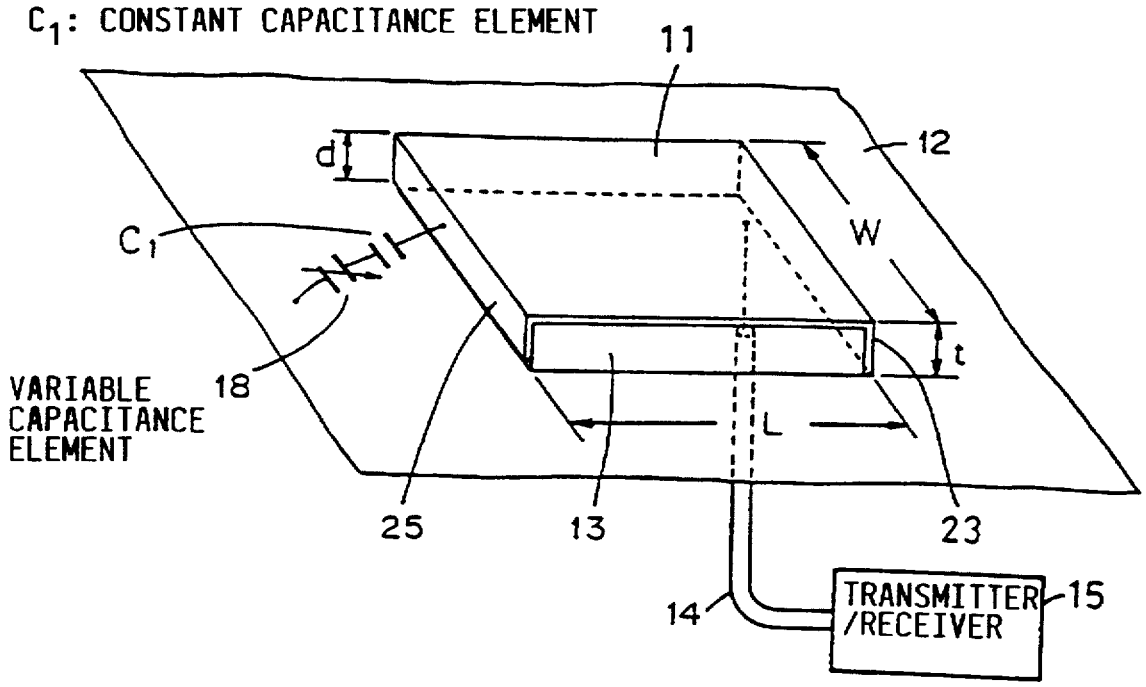
FIG. 32 is a perspective view showing another modified form of the FIG. 24 embodiment which has a series connection of a constant capacitance element and a variable capacitance element.

FIGS. 31 and 32 illustrate modified forms of the FIG. 26 embodiment in which the capacitor $C_1$ is replaced by the variable capacitance element 18 in FIG. 12 and by the series connection of the constant capacitance element $C_1$ and the variable capacitance element 18 in FIG. 13, respectively. Also in these cases, the resonance frequency of the antenna can always be set at the channel frequency used by changing the capacitance of the variable capacitance element 18 with the channel control signal P from the radio circuit part 115 as in the case of FIG. 30A. Since the radiating patch 11 is shorted to the ground plate 12 by the short-circuit plate 23, the variable capacitance element 18 becomes equipotential across it DC-wise in the example of FIG. 31, but as mentioned previously, the resonance frequency can be changed by using a transistor or field effect transistor as the variable capacitance element. In the embodiment of FIG. 32, however, since the variable capacitance element 18 and the constant capacitance element $C_1$ are connected in series to the radiating end of the antenna, the variable capacitance element 18 can be disconnected at one end DC-wise from the radiating patch 11 and the ground plate 12, and hence a DC bias can be applied directly to the variable capacitance element 18.

With such structures as depicted in FIGS. 31 and 32, it is possible to realize small and high efficiency antennas whose resonance frequency can be varied continuously by controlling the capacitance of the variable capacitance element 18 with the signal from the radio circuit part 115 so that they operate over a wide frequency range.

Figure 33:
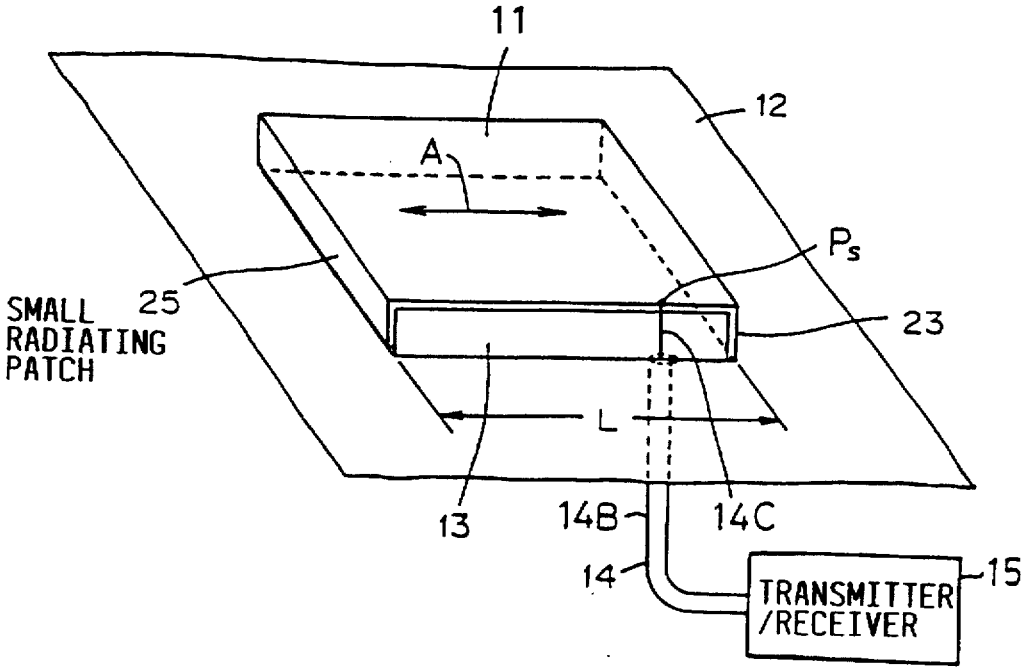
FIG. 33 is a perspective view illustrating another embodiment of the present invention which has a feeder connected to one side of the radiating patch which is parallel to the direction of resonance.

FIG. 33 illustrates an embodiment of the connection of the microstrip antenna according to the present invention. Even when a feeding point Ps is positioned at the marginal edge of the radiating patch 11 parallel to the direction of resonance A as depicted in FIG. 33, resonance can be produced normally. In this instance, it is necessary only to fix the inner conductor 14C of the feeder 14 on one side wall of the dielectric substrate 13 and connect it to the marginal edge of the radiating patch 11. This avoids the necessity of making a hole in the dielectric substrate 13 and passing therethrough the inner conductor 14C of the feeder 14 as in the embodiments described above, and hence permits simplification of the manufacturing process and cutting the manufacturing costs accordingly. This technique is applicable also to all microstrip antenna structures of the embodiments described above. When employing this technique, the above-described embodiments of the present invention all provide exactly the same advantages of the miniaturization of antenna structure, multiple resonance points and so forth.

Figure 34:
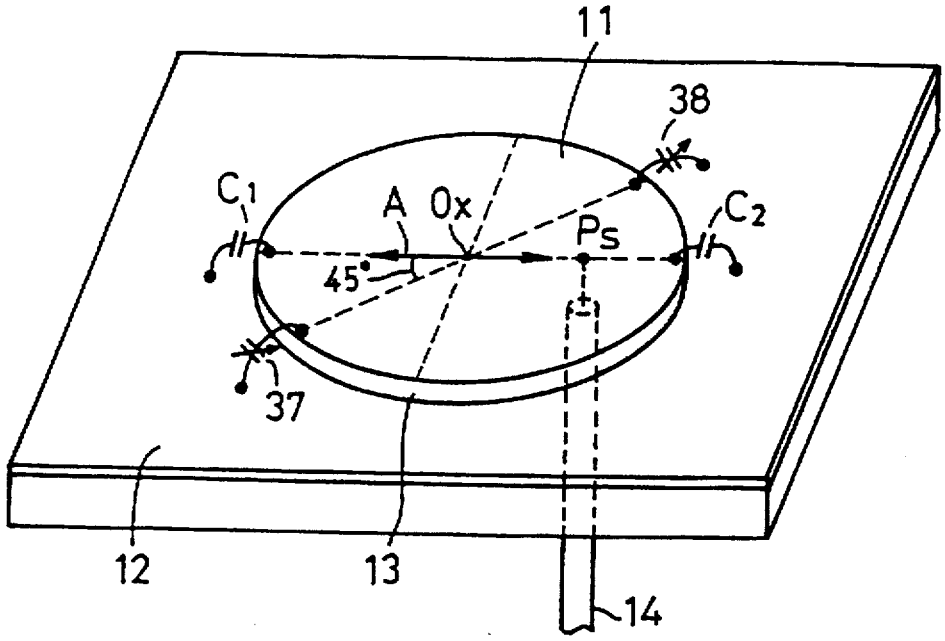
FIG. 34 is a perspective view illustrating an embodiment of the present invention applied to a conventional circular-polarized-wave microstrip antenna.

FIG. 34 illustrates an embodiment in which the principle of the present invention is applied to the microstrip antenna disclosed in Japanese Patent Application Laid-Open No. 29204/83 previously cited as the prior art. In this prior art example, the direction of resonance A coincides with a straight line joining the center Ox of a circular (or square) radiating patch 11 and the feeding point Ps and a circular polarized wave radiating characteristic is obtained by connecting variable capacitance elements 37 and 38 between the radiating patch 11 and the ground plate 12 at points diametrically opposite across the former at 45 degrees to the direction A. In the FIG. 34 embodiment utilizing the present invention, the diameter of the radiating patch 11 can be reduced with respect to a predetermined frequency by further connecting capacitors $C_1$ and $C_2$ between the radiating patch 11 and the ground plate 12 at one or both ends of the radiating patch 11 in the direction of resonance A.

Figure 35:
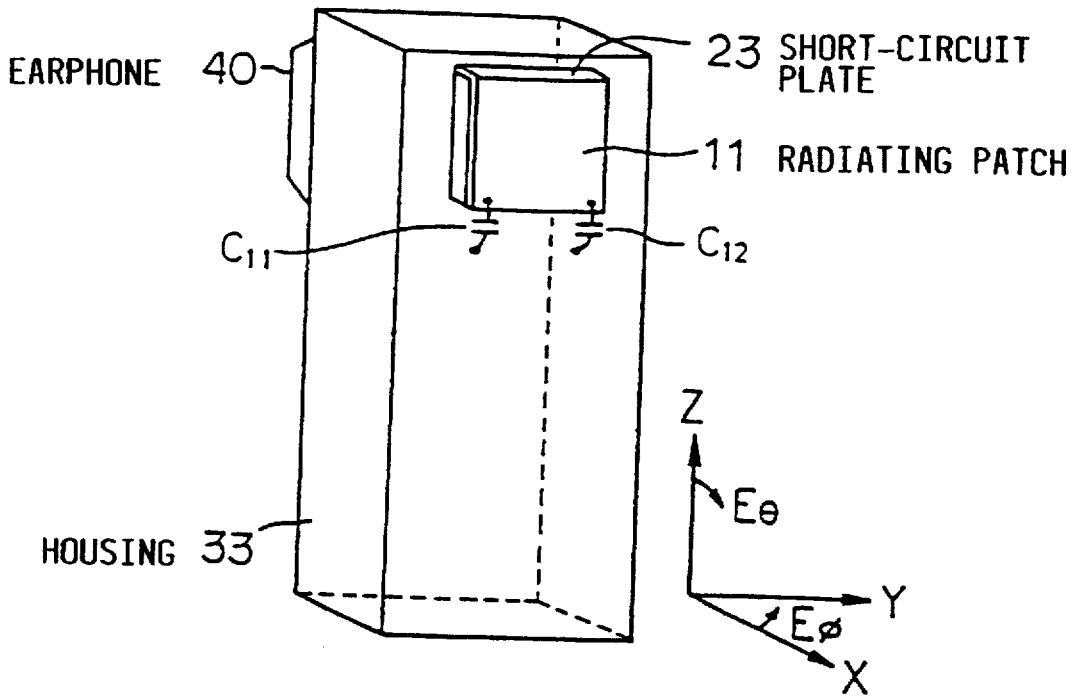
FIG. 35 is a perspective view for explaining how the microstrip antenna device is mounted on a housing.

FIG. 35 illustrates a structure for a portable radio or telephone wherein an earphone 40 is mounted on one side of a housing 33 and the microstrip antenna of a desired one of the above-described embodiments according to the present invention is mounted on the other side of the housing. The embodiment of FIG. 35 is shown to employ the microstrip antenna depicted in FIG. 18B. That is, the microstrip antenna, which is made up of the short-circuit plate 23, the radiating patch 11 and the capacitors $C_{11}$ and $C_{12}$ connected between free end portions of the radiating patch 11 and the housing 33 formed of a conductive material, is mounted on the side of the housing 33 opposite to the earphone 40.

With the structure wherein the antenna device is placed on the side of the housing 33 opposite to the earphone 40, it is possible to avoid the possibility of a user inadvertently covering the antenna portion with his hand when holding the housing to press the earphone 40 against his ear. This prevents the antenna characteristic from being affected by user's hand.

Figure 36:
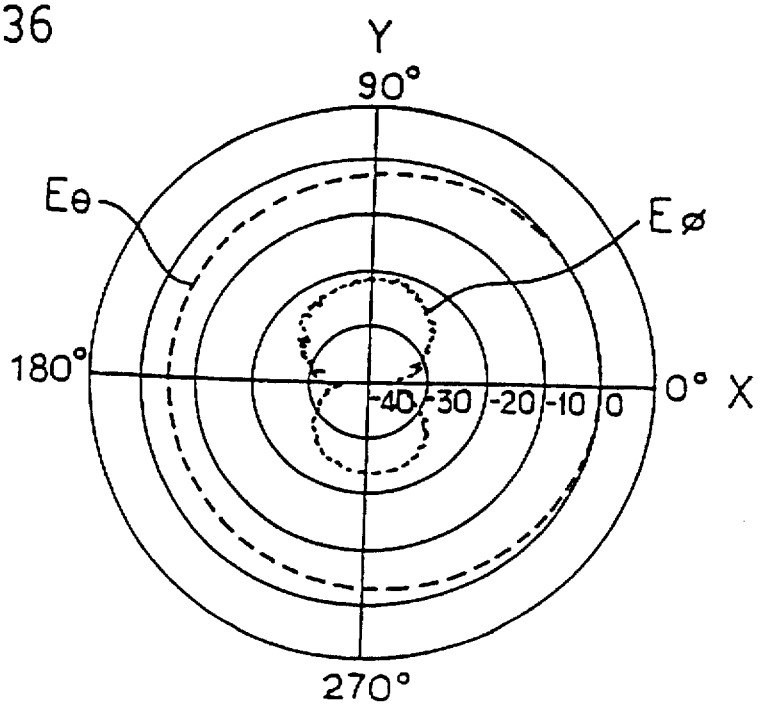
FIG. 36 is a radiation characteristic diagram for explaining the operation of the embodiment depicted in FIG. 35.

In FIG. 36 there is shown a radiation pattern of the microstrip antenna of the FIG. 35 structure. By placing the short-circuit plate 23 and the radiating patch 11 in the lengthwise direction of the housing 33 as depicted in FIG. 35, an $E_\theta$ component, which is the main polarized wave of the radiation pattern, is radiated with high intensity on the side of the antenna (on the plus side of the X axis). When using the portable radio or telephone, the user presses the earphone 40 against his ear and hence he approaches the earphone side (the minus side of the X axis). On this account, the radiation pattern shown in FIG. 36 is smaller in the amount of radiation toward the user than in the case of radiation with a uniform intensity over the entire angular range of 360 degrees. Accordingly, the influence of the user on the antenna characteristic can be lessened.

Incidentally, it can easily be understood that the antenna arrangement of FIG. 35 is applicable to the microstrip antennas of all the embodiments described above.

EFFECT OF THE INVENTION

As described above, according to a first aspect of the present invention, the antenna length can be reduced by providing an additional capacitance between the open marginal edge of the radiating patch 11 and the ground plate 12. The capacitance is added by placing the metal plate 21 (22) on the ground plate 12 in opposed relation to the open marginal edge 11*a* of the radiating patch 11, connecting a capacitor between the open marginal edge of the radiating patch 11 and the ground plate 12, or forming the small radiating patch 25 by bending the open marginal portion of the radiating patch 11 at right angles into opposing relation to the ground plate 12. The antenna length can be further decreased by connecting the constant capacitance element $C_1$ between the open marginal edge 11*a* and the metal plate 21, or between the small radiating patch 25 and the ground plate 12.

According to a second aspect of the present invention, when the above-mentioned capacitor $C_1$ is replaced by a series connection of the switch 16 and the capacitor C1, two resonance frequencies can be selected and, when substituting a variable capacitance, the resonance frequency can be varied continuously. The same is true of the replacement of the capacitor $C_1$ with a series connection of the constant capacitance element $C_1$ and the variable capacitance element 18. Similarly, when the constant capacitance element $C_1$ connected between the open marginal edge 11*a* and the metal plate 21 is replaced by a series connection of the constant capacitance element $C_1$ and the switch 16, or the variable capacitance element 18, or a series connection of the constant capacitance element $C_1$ and the variable capacitance element 18, it is possible to select a plurality of resonance frequencies or continuously vary the resonance frequency.

We claim:

1. A microstrip antenna device comprising:

a ground plate;

a radiating patch disposed opposite said ground plate substantially in parallel thereto;

a coaxial feeder having its inner conductor and outer conductor connected to a point on said radiating patch and said ground plate, respectively, said point on said radiating patch defining a direction of electromagnetic resonance in said antenna;

added capacitance means provided between said ground plate and each of two opposite marginal edges of said radiating patch in said direction of resonance;

said two opposite marginal edges of said radiating patch in said direction of resonance being electrically open;

the length of said radiating patch in said direction of resonance being smaller than one-half of the resonance wavelength used;

said added capacitance means comprising two metal plates supported on said ground plate vertically to said radiating patch and said ground plate in adjacent but spaced relation to said opposite marginal edges of said radiating patch in said direction of resonance, the heights h of said metal plates from said ground plate being $0<h\leqq 3$ t, where t is the spacing between said radiating patch and said ground plate; and said added capacitance means comprising capacitors connected between said two metal plates and the opposite marginal edges of said radiating patch adjacent to said metal plates, respectively.

2. A microstrip antenna device comprising:

a ground plate;

a radiating patch disposed opposite said ground plate substantially in parallel thereto;

a coaxial feeder having its inner conductor and outer conductor connected to a point on said radiating patch and said ground plate, respectively, said point on said radiating patch defining a direction of electromagnetic resonance in said antenna;

the length of said radiating patch in said direction of resonance being smaller than a quarter of the resonance wavelength used;

added capacitance means provided between said ground plate and each of two opposite marginal edges of said radiating patch in said direction of resonance;

said radiating patch having one of said two opposite marginal edges electrically open in said direction of resonance and having the other of said marginal edges shorted by a short-circuit plate to said ground plate, said added capacitance means being provided at said one marginal edge of said radiating patch;

said added capacitance means comprising a metal plate supported on said ground plate vertically to said radiating patch and said ground plate in adjacent but spaced relation to said one marginal edge of said radiating patch in said direction of resonance, and capacitor means connected between said metal plate and one marginal edge of said radiating patch adjacent to said metal plate;

the height h of said metal plate from said ground plate being $0<h\leqq 3$ t, where t is the spacing between said radiating patch and said ground plate.

3. The microstrip antenna device of claim 2; wherein said capacitor means comprises two capacitors connected between opposite ends of said one marginal edge of said radiating patch and said ground plate, respectively.

4. A microstrip antenna device comprising:

a ground plate;

a radiating patch disposed opposite said ground plate substantially in parallel thereto;

a coaxial feeder having its inner conductor and outer conductor connected to a point on said radiating patch and said ground plate, respectively, said point on said radiating patch defining a direction of electromagnetic resonance in said antenna, the length of said radiating patch in said direction of resonance being smaller than a quarter of the resonance wavelength used;

added capacitance means provided between said ground plate and each of two opposite marginal edges of said radiating patch in said direction of resonance;

said radiating patch having one of said two opposite marginal edges electrically open in said direction of resonance and having the other of said marginal edges shorted by a short-circuit plate to said ground plate, said added capacitance means being provided at said one marginal edge of said radiating patch;

said added capacitance means comprising a small radiating patch extended from said one marginal edge of the first mentioned radiating patch toward said ground plate so that its lower marginal edge is adjacent but spaced from said ground plate, and capacitor means connected between said small radiating patch and said ground plate.

5. The microstrip antenna device of claim 4, wherein said capacitor means comprises two capacitors connected between opposite ends of said small radiating patch and said ground plate, respectively.

6. The microstrip antenna device of claim 4, wherein said capacitor means comprises a series connection of a capacitor and a switch connected between said small radiating patch and said ground plate.

7. The microstrip antenna device of claim 4, wherein said capacitor means comprises a variable capacitance element connected between said small radiating patch and said ground plate.

8. The microstrip antenna device of claim 4, wherein said capacitor means comprises a series connection of a capacitor and a variable capacitance element connected between said small radiating patch and said ground plate.

9. The microstrip antenna device of one of claims 1, 2 or 4 wherein said antenna device is mounted on one side of a housing of a portable radio unit, an earphone mounted on the other side of said housing of said portable radio unit opposite to the side where said microstrip antenna device is mounted, the main current direction on said microstrip antenna device being in coincidence with a lengthwise direction of said portable radio unit.

* * * * *